US007887995B2

(12) United States Patent
Niwa et al.

(10) Patent No.: US 7,887,995 B2
(45) Date of Patent: Feb. 15, 2011

(54) ELECTROFORMING MOLD AND METHOD FOR MANUFACTURING THE SAME, AND METHOD FOR MANUFACTURING ELECTROFORMED COMPONENT

(75) Inventors: Takashi Niwa, Chiba (JP); Susumu Ichihara, Chiba (JP); Koichiro Jujo, Chiba (JP); Hiroyuki Hoshina, Chiba (JP)

(73) Assignee: Seiko Instruments Inc. (JP)

( * ) Notice: Subject to any disclaimer, the term of this patent is extended or adjusted under 35 U.S.C. 154(b) by 1433 days.

(21) Appl. No.: 11/326,149

(22) Filed: Jan. 5, 2006

(65) Prior Publication Data

US 2006/0160027 A1 Jul. 20, 2006

(30) Foreign Application Priority Data

Jan. 14, 2005 (JP) ..... 2005-007052
Jul. 13, 2005 (JP) ..... 2005-203983
Nov. 21, 2005 (JP) ..... 2005-335328

(51) Int. Cl.
*G03F 7/00* (2006.01)

(52) U.S. Cl. ..... 430/312; 438/689

(58) Field of Classification Search ..... 430/320
See application file for complete search history.

(56) References Cited

U.S. PATENT DOCUMENTS 5,488,253 A 1/1996 Matsuoka ..... 257/622
5,783,371 A * 7/1998 Bifano ..... 430/321
5,944,974 A * 8/1999 Fahrenberg et al. ..... 205/70
6,036,832 A 3/2000 Knol et al. ..... 205/50
6,586,112 B1 7/2003 Te ..... 428/596
2004/0191704 A1* 9/2004 Nishi et al. ..... 430/324

FOREIGN PATENT DOCUMENTS

EP 1462859 9/2004
JP 02-043380 * 2/1990
JP 10-245692 * 9/1998
WO 2004101857 11/2004

OTHER PUBLICATIONS translation JP-10-245692(Sep. 1998).*

* cited by examiner

*Primary Examiner*—Cynthia H Kelly
*Assistant Examiner*—Anna L Verderame
(74) *Attorney, Agent, or Firm*—Adams & Wilks

(57) ABSTRACT

An electroforming mold has a first negative type photosensitive material formed on an electroconductive substrate, and a first through-hole extends through the firs photosensitive material to expose the electroconductive substrate. An electroconductive layer formed on an upper face of the first photosensitive material surrounds the first through-hole. A second negative type photosensitive material formed on an upper face of the electroconductive layer has a second through-hole that overlies and exposes both the first through-hole and a peripheral part of the electroconductive layer that surrounds the first through-hole. Because the electroconductive substrate and the electroconductive layer are separated from one another, the first and second through-holes precipitate an electroformed object independently during use of the electroforming mold resulting in a uniform electroformed object.

37 Claims, 16 Drawing Sheets

FIG. 9
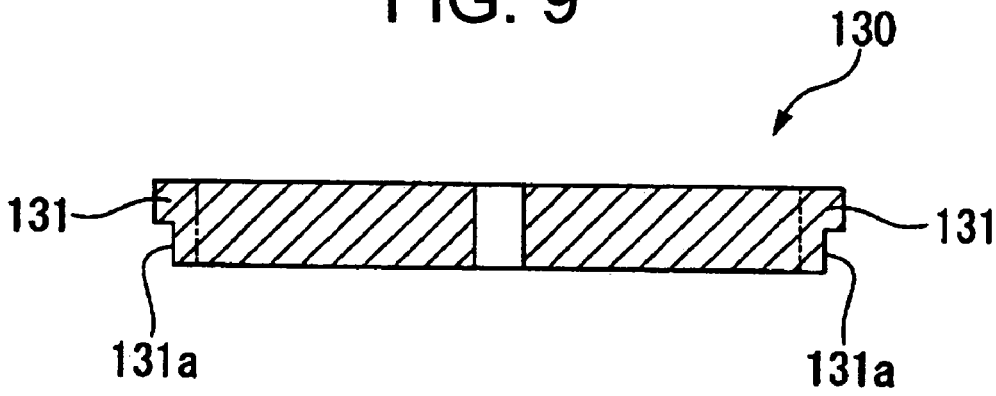
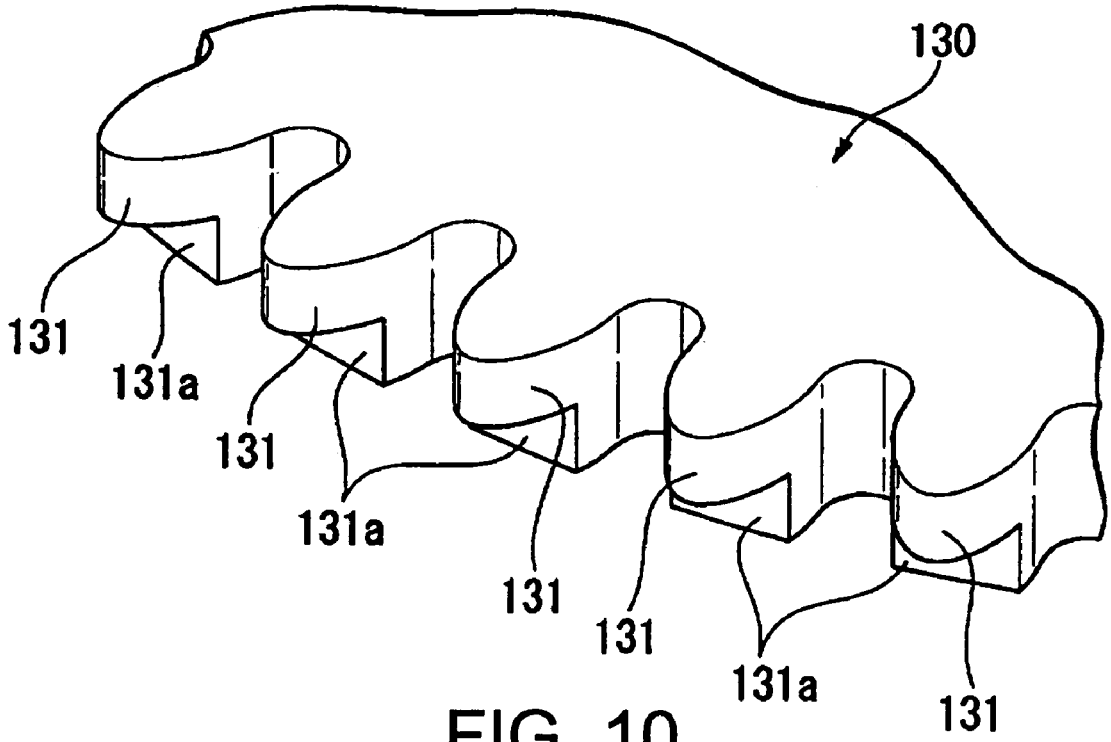
FIG. 10

FIG. 11
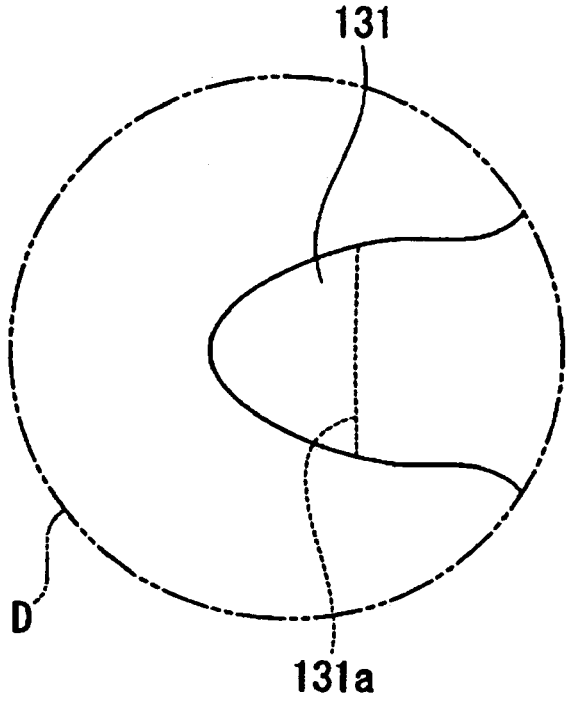
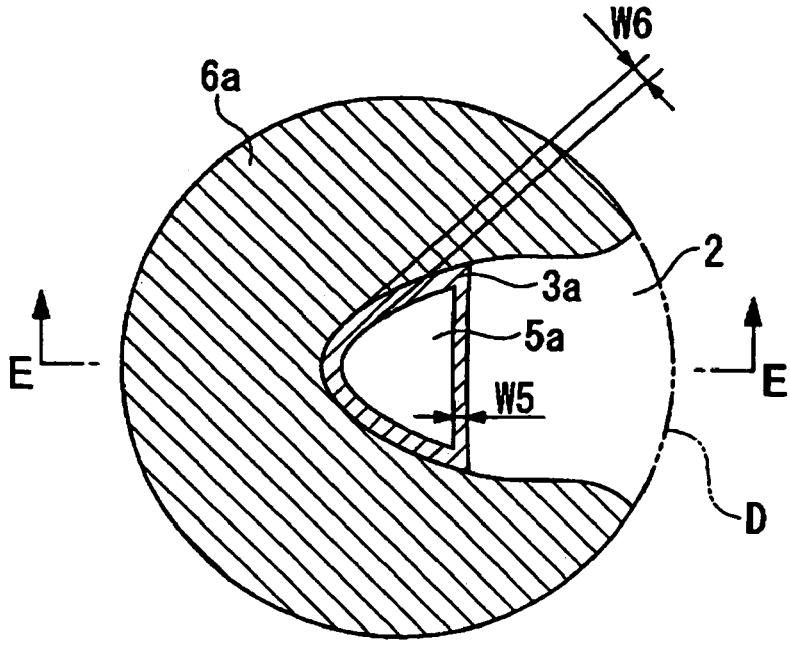
FIG. 12

ELECTROFORMING MOLD AND METHOD FOR MANUFACTURING THE SAME, AND METHOD FOR MANUFACTURING ELECTROFORMED COMPONENT

BACKGROUND OF THE INVENTION

1. Field of the Invention

The present invention relates to a mold of a minute component and a method for manufacturing the same, and a method for manufacturing a minute component; in particular, to a mold of an electroformed component having a multistage structure and a method for manufacturing the same, and a method for manufacturing an electroformed component.

2. Description of the Related Art

Conventional multistage electroforming molds include a concave portion constituted of a basal part formed of a substrate and side walls formed by a resist agent on the upper face of the substrate, wherein a multistage configuration was obtained by forming a second layer mold on a component of a first layer having been formed in the concave portion by an electroforming method. In conventional electroforming molds and methods for manufacturing an electroformed component, therefore, it was necessary to form layers of a mold and a component layer by layer in accordance with number of steps included in a component.

FIG. 21 shows a conventional electroformed component and method for manufacturing an electroforming mold. In FIG. 21(*a*), first, a resist agent 3*a*' is formed on the surface of a substrate 1', a photo mask 4*a*' having been formed of a pattern of a first layer of the component is arranged on the upper face thereof, and then exposure is carried out. In FIG. 21(*b*), the exposed area of the resist agent 3*a*' is removed by development. In FIG. 21(*c*), electroforming is carried out for a region formed by the development to form the first layer of a component 100*a*', and then in FIG. 21(*d*) the resist agent 3*a*' and the photo mask 4*a*' are removed. Next, in FIG. 21(*e*), a resist agent 3*b*' is formed so as to cover the formed component 100*a*', a photo mask 4*b*' having been formed of a pattern for a second layer of the component is arranged on the upper face thereof, and exposure is carried out. In FIG. 21(*f*), the exposed area of the resist agent 3*b*' is removed by development. In FIG. 21(*g*), electroforming is carried out for a region formed by the development to form the second layer of the component 100*b*', and then in FIG. 21(*h*) the resist agent 3*b*' and the photo mask 4*b*' are removed, to complete the component 100'.

SUMMARY OF THE INVENTION

However, according to the electroforming mold and the method for manufacturing the same mentioned above, it was required to manufacture a component and an electroforming mold layer by layer in accordance with number of steps included in a component.

Further, since height control of the layer of a component precipitated by electroforming is difficult, the surface does not become even. Since a mold and a component of the following layer are formed on the upper face of the layer of the component having an uneven surface and a step portion, there is difficulty in forming the mold and the component of the following layer as well as in height control. Controlling the thickness of the electroforming mold step by step is possible through a grinding process, but ground residues through the grinding remain on the electroforming mold and the resist, thereby making height control in post-processes difficult. Further, when electroforming is carried out in a state of being divided into multiple cycles, there also occurs such problems that adhesive power between the interface of respective layers weakens to decrease strength of an electroformed object, and that, caused by different stresses of the electroformed objects formed in respective electroforming processes, configuration of the electroformed object changes.

The invention is going to solve such problems that exist in a conventional electroforming mold and a method for manufacturing an electroformed component, and aims to manufacture an electroforming mold capable of height control as well as to manufacture an intended component in one electroforming process.

The method for manufacturing an electroforming mold according to the invention includes the steps of forming a first negative type photosensitive material on the upper face of an electroconductive substrate, exposing the first negative type photosensitive material through a photomask pattern arranged above the first negative type photosensitive material, forming a positive type photosensitive material on the upper face of the first negative type photosensitive material, exposing the positive type photosensitive material through a photomask pattern arranged above the positive type photosensitive material, developing the positive type photosensitive material to remove the exposed region of the positive type photosensitive material, forming a film of an electroconductive layer on the upper faces of the first negative type photosensitive material exposed by removing the exposed region of the positive type photosensitive material and the positive type photosensitive material, removing the positive type photosensitive material and the electroconductive layer formed on the upper face of the positive type photosensitive material, forming a second negative type photosensitive material on the upper face of the first negative type photosensitive material exposed by removing the electroconductive layer and the positive type photosensitive material and on the upper face of the electroconductive layer, exposing the second negative type photosensitive material through a photomask pattern arranged above the second negative type photosensitive material, and developing the first negative type photosensitive material and the second negative type photosensitive material to remove the unexposed region of the first negative type photosensitive material and the unexposed region of the second negative type photosensitive material.

Further, the method for manufacturing an electroforming mold according to the invention includes the steps of forming a film of a first electroconductive layer on the upper face of a substrate, forming a first negative type photosensitive material on the upper face of the first electroconductive layer, exposing the first negative type photosensitive material through a photomask pattern arranged above the first negative type photosensitive material, forming a positive type photosensitive material on the upper face of the first negative type photosensitive material, exposing the positive type photosensitive material through a photomask pattern arranged above the positive type photosensitive material, developing the positive type photosensitive material to remove the exposed region of the positive type photosensitive material, forming a film of a second electroconductive layer on the upper faces of the first negative type photosensitive material exposed by removing the exposed region of the positive type photosensitive material and the positive type photosensitive material, removing the positive type photosensitive material and the second electroconductive layer formed on the upper face of the positive type photosensitive material, forming a second negative type photosensitive material on the upper face of the first negative type photosensitive material exposed by removing the second electroconductive layer and the positive type photosensitive material and on the upper face of the second electroconductive layer, exposing the second negative type photosensitive material through a photomask pattern arranged above the upside of the second negative type photosensitive material, and developing the first negative type photosensitive material and the second negative type photosensitive material to remove the unexposed region of the first negative type photosensitive material and the unexposed region of the second negative type photosensitive material.

Further, the method for manufacturing an electroforming mold according to the invention includes the steps of forming a first positive type photosensitive material on the upper face of an electroconductive substrate, exposing the first positive type photosensitive material through a photomask pattern arranged above the first positive type photosensitive material, forming a negative type photosensitive material on the upper face of the first positive type photosensitive material, exposing the negative type photosensitive material through a photomask pattern arranged above the negative type photosensitive material, developing the negative type photosensitive material to remove the unexposed region of the negative type photosensitive material, forming a film of an electroconductive layer on the upper faces of the first positive type photosensitive material exposed by removing the exposed region of the negative type photosensitive material and the negative type photosensitive material, removing the negative type photosensitive material and the electroconductive layer formed on the upper face of the negative type photosensitive material, forming a second positive type photosensitive material on the upper face of the first positive type photosensitive material exposed by removing the negative type photosensitive material and on the upper face of the electroconductive layer, exposing the second positive type photosensitive material through a photomask pattern arranged above the second positive type photosensitive material, and developing the first positive type photosensitive material and the second positive type photosensitive material to remove the exposed region of the first positive type photosensitive material and the exposed region of the second positive type photosensitive material.

Further, the method for manufacturing an electroforming mold according to the invention includes the steps of forming a positive type photosensitive material on the upper face of an electroconductive substrate, exposing the positive type photosensitive material through a photomask pattern arranged above the positive type photosensitive material, forming a first negative type photosensitive material on the upper face of the positive type photosensitive material, exposing the first negative type photosensitive material through a photomask pattern arranged above the first negative type photosensitive material, developing the first negative type photosensitive material to remove the unexposed region of the first negative type photosensitive material, forming a film of an electroconductive layer on the upper faces of the positive type photosensitive material exposed by removing the exposed region of the first negative type photosensitive material and the first negative type photosensitive material, removing the first negative type photosensitive material and the electroconductive layer formed on the upper face of the first negative type photosensitive material, forming a second negative type photosensitive material on the upper side of the positive type photosensitive material exposed by removing the electroconductive layer and the first negative type photosensitive material and on the upper face of the electroconductive layer, exposing the second negative type photosensitive material through a photomask pattern arranged above the second negative type photosensitive material, and developing the positive type photosensitive material and the second negative type photosensitive material to remove the exposed region of the positive type photosensitive material and the unexposed region of the second negative type photosensitive material.

Further, the method for manufacturing an electroforming mold according to the invention includes the steps of forming a first negative type photosensitive material on the upper face of an electroconductive substrate, forming a positive type photosensitive material on the upper face of the first negative type photosensitive material, exposing the positive type photosensitive material through a mask pattern arranged above the positive type photosensitive material, developing the positive type photosensitive material to remove the exposed region of the positive type photosensitive material, forming a film of an electroconductive layer on the upper faces of the first negative type photosensitive material exposed by removing the exposed region of the positive type photosensitive material and the positive type photosensitive material, removing the positive type photosensitive material and the electroconductive layer formed on the upper face of the positive type photosensitive material, forming a second negative type photosensitive material on the upper face of the first negative type photosensitive material exposed by removing the electroconductive layer and the positive type photosensitive material and on the upper face of the electroconductive layer, exposing the second negative type photosensitive material through a mask pattern arranged above the second negative type photosensitive material, and developing the first negative type photosensitive material and the second negative type photosensitive material to remove the unexposed region of the first negative type photosensitive material and the unexposed region of the second negative type photosensitive material.

Further, the method for manufacturing an electroforming mold according to the invention includes the steps of forming a layer of a first electroconductive layer on the upper face of a substrate, forming a first negative type photosensitive material on the upper face of the first electroconductive layer, forming a positive type photosensitive material on the upper face of the first negative type photosensitive material, exposing the positive type photosensitive material through a mask pattern arranged above the positive type photosensitive material, developing the positive type photosensitive material to remove the exposed region of the positive type photosensitive material, forming a film of a second electroconductive layer on the upper faces of the first negative type photosensitive material exposed by removing the exposed region of the positive type photosensitive material and the positive type photosensitive material, removing the positive type photosensitive material and the second electroconductive layer formed on the upper face of the positive type photosensitive material, forming a second negative type photosensitive material on the upper face of the first negative type photosensitive material exposed by removing the second electroconductive layer and the positive type photosensitive material and on the upper face of the second electroconductive layer, exposing the second negative type photosensitive material through a mask pattern arranged above the second negative type photosensitive material, and developing the first negative type photosensitive material and the second negative type photosensitive material to remove the unexposed region of the first negative type photosensitive material and the unexposed region of the second negative type photosensitive material.

The electroforming mold according to the invention includes an electroconductive substrate, a first negative type photosensitive material that is formed on the upper face of the electroconductive substrate and has a first through-hole in the thickness direction, an electroconductive layer formed on a part of the face of the first negative type photosensitive material opposite the face being in contact with the electroconductive substrate, and a second negative type photosensitive material that is formed on a part of the face of the electroconductive layer opposite the face being in contact with the first negative type photosensitive material and has a second through-hole above the face including the aperture face of the first through-hole with respect to the upper face of the first negative type photosensitive material.

Further, the electroforming mold of the invention includes a first electroconductive layer formed on a substrate, a first negative type photosensitive material that is formed on the face of the first electroconductive layer opposite the face being in contact with the substrate and has a first through-hole in the thickness direction, a second electroconductive layer formed on a part of the face of the first negative type photosensitive material opposite the face being in contact with the first electroconductive layer, and a second negative type photosensitive material formed on a part of the face of the second electroconductive layer opposite the face being in contact with the first negative type photosensitive material and has a second through-hole above the face including the aperture face of the first through-hole with respect to the upper face of the first negative type photosensitive material.

Further, the electroforming mold according to the invention includes an electroconductive substrate, a first negative type photosensitive material that is formed on the upper face of the electroconductive substrate and has a first through-hole in the thickness direction, a second negative type photosensitive material that is formed on a part of the upper face of the first negative type photosensitive material and has a second through-hole passing through in the thickness direction on the upside of the first through-hole, and an electroconductive layer formed within the second through-hole and on the upper face of the first negative type photosensitive material.

Further, the electroforming mold according to the invention includes a substrate, a first electroconductive layer formed on the upper face of the substrate, a first negative type photosensitive material that is formed on the upper face of the first electroconductive layer and has a through-hole in the thickness direction, a second negative type photosensitive material that is formed on a part of the upper face of the first negative type photosensitive material and has a second through-hole passing through in the thickness direction above the first through-hole, and a second electroconductive layer formed within the second through-hole and on the upper face of the first negative type photosensitive material.

The method for manufacturing an electroformed component according to the invention includes the steps of dipping an electroforming mold in an electroforming liquid, the electroforming mold having an electroconductive substrate, a first negative type photosensitive material that is formed on the upper face of the electroconductive substrate and has a first through-hole in the thickness direction, an electroconductive layer formed on a part of the face of the first negative type photosensitive material opposite the face being in contact with the electroconductive substrate, a second negative type photosensitive material that is formed on a part of the face of the electroconductive layer opposite the face being in contact with the first negative type photosensitive material and has a second through-hole above the face including an aperture face of the first through-hole with respect to the upper face of the first negative type photosensitive material, applying voltage to the electroconductive substrate, precipitating a metal on the exposed face of the electroconductive substrate, bringing a part of the precipitated metal into contact with the electroconductive layer to apply voltage to the electroconductive layer, and precipitating a metal on the exposed face of the precipitated metal and the exposed face of the electroconductive layer.

Further, the method for manufacturing an electroformed component according to the invention includes the steps of dipping an electroforming mold in an electroforming liquid, the electroforming mold having a first electroconductive layer formed on a substrate, a first negative type photosensitive material that is formed on the face of the first electroconductive layer opposite the face being in contact with the substrate and has a first through-hole in the thickness direction, a second electroconductive layer formed on a part of the face of the first negative type photosensitive material opposite the face being in contact with the first electroconductive layer, a second negative type photosensitive material that is formed on a part of the face of the second electroconductive layer opposite the face being in contact with the first negative type photosensitive material and has a second through-hole above the face including an aperture face of the first through-hole with respect to the upper face of the first negative type photosensitive material, applying voltage to the first electroconductive layer, precipitating a metal on the exposed face of the first electroconductive layer, bringing a part of the precipitated metal into contact with the second electroconductive layer to apply a voltage to the second electroconductive layer, and precipitating a metal on the exposed face of the precipitated metal and the exposed face of the second electroconductive layer.

In the electroforming mold and the method for manufacturing the same according to the invention, upon manufacturing a multistage electroformed component, without forming a mold for forming a following layer on the layer of the formed component through removing a resist forming the side wall of an electroforming mold every time when one layer is formed, negative resists are formed and exposed, and, after superimposing negative resists of respective stages into a laminated layer, development is carried out, thereby manufacturing a multistage electroforming mold having an electroconductive layer on a basal part of respective step portions. Accordingly, it becomes unnecessary to carry out electroforming every time when respective stages are formed, and an intended component can be formed in one electroforming process.

Further, since a mold is manufactured without forming a resist for a following layer on the layer of a component under a forming process, it is possible to manufacture a mold capable of height control as well as to prevent the interface of layers between the electroformed parts from becoming uneven or height thereof from becoming uneven.

Further, when an electroconductive layer is formed on the surface of a resist in a lower layer so that the lower resist layer has a region being in contact with an upper resist layer, since the degree of adhesion increases in the region where the resists having affinity are in contact with each other, strong connection can be achieved. Thus, a mold with a high strength can be obtained as an electroforming mold.

Furthermore, when a mold is formed so that it has plural concave portions on one substrate and that each of electroconductive layers arranged on the respective concave portions is arranged so as to be separated from electroconductive layers arranged for other concave portions, since each of concave portions precipitates an electroformed object independently, a uniform electroformed component can be obtained.

BRIEF DESCRIPTION OF THE DRAWINGS

FIG. 9 is a cross sectional side view with respect to the arrows C-C shown in FIG. 8.

FIG. 10 is an enlarged perspective view of the cog portion of the gear shown in FIG. 8.

FIG. 11 is an enlarged drawing of a portion shown as D in FIG. 8.

FIG. 12 is a top view of an electroforming mold corresponding to the portion shown as D in FIG. 8.

DESCRIPTION OF THE PREFERRED EMBODIMENTS

Figure 1A:
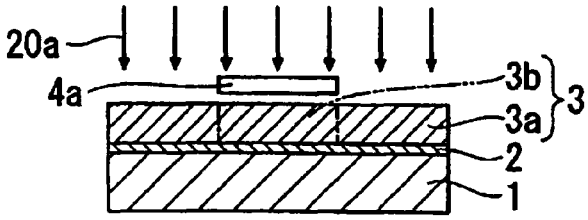
FIG. 1 is a drawing showing the method for manufacturing an electroforming mold in a first embodiment.
Figure 1B:
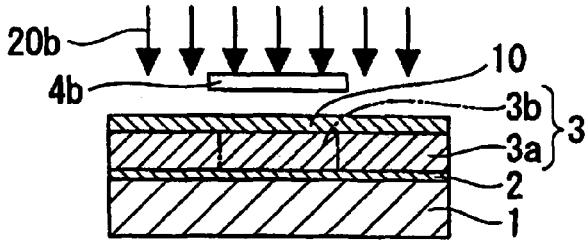
Figure 1C:
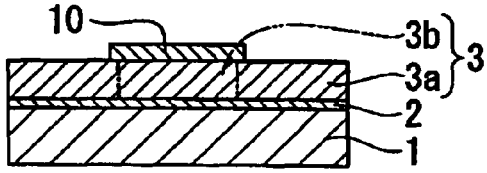
Figure 1D:
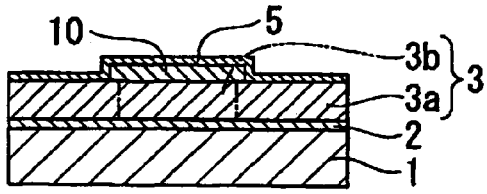
Figure 1E:
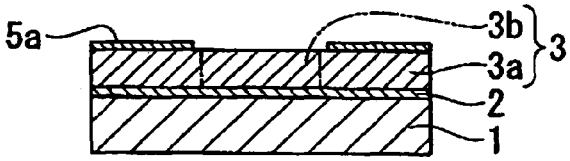
Figure 1F:
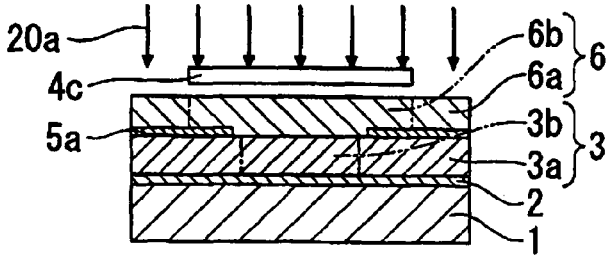
Figure 1G:
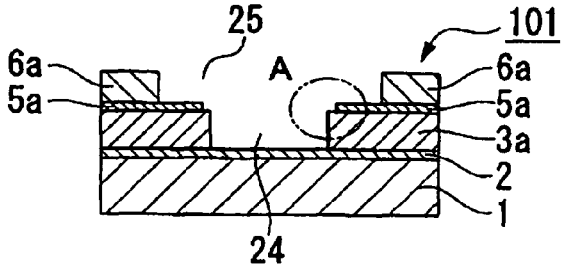

Hereinafter, embodiments of the invention will be described based on FIGS. 1 to 6.

Embodiment 1

FIG. 1 is a drawing to describe an electroforming mold 101 and the method for manufacturing the same according to a first embodiment of the invention.

First, in FIG. 1(*a*), an electroconductive layer 2 is formed on the upper face of a substrate 1, next a photoresist 3 is formed on the upper face of the electroconductive layer 2, then a photo mask (mask pattern) 4*a* is registered above a portion for forming an unexposed region which will become a soluble portion 3*b* described later, followed by irradiating ultraviolet light 20*a* to perform exposure, thereby forming an insoluble portion 3*a* being the exposed region and a soluble portion 3*b* being an unexposed region.

Thickness of the substrate 1 is around from 100 μm to 10 mm. A thickness that can keep strength of the electroforming mold 101 in an electroforming process, grinding process and the like described later may be sufficient. Thickness of an electroconductive layer 2 is around from 5 nm to 10 μm. A thickness that makes conduction possible in an electroforming process described later may be sufficient. Thickness of a photoresist 3 is form 1 μm to 5 mm, which is approximately the same thickness as that of the first step of an electroformed object to be produced. As for material of the substrate 11, a material generally used in the silicon process such as glass and silicon, or a metal material such as stainless steel and aluminum is used. Material of the electroconductive layer 2 is gold (Au), silver (Ag), nickel (Ni) or the like, and chromium (Cr), titanium (Ti) or the like may be formed between the electroconductive layer 2 and the substrate 1 as an anchor metal (not shown) for strengthening adhesion force of the electroconductive layer 2. In this connection, when the material of the substrate 1 is a metal, the electroconductive layer 2 is not necessarily required. As the photoresist 3, a negative type photoresist is used.

Further, the photoresist 3 may also be a chemical amplification type photoresist. When producing a structure with a high aspect ratio, for the photoresist 3, use of an epoxy-type resin-based chemical amplification type photoresist is desirable. Further, as for the photoresist 3, a photoresist, which is insoluble in a developer of a light-absorbing body 10 in a developing process of the light-absorbing body 10 described later, is used. A formation method of the electroconductive layer 2 is a sputtering method, vacuum evaporation method, or the like. A formation method of the photoresist 3 is spin coating, dip coating or spray coating, or a photoresist film in sheet may be stuck to the substrate 1. Further, plural photoresist films in sheet may be laminated to give a photoresist 3 having an intended thickness. In order to form the insoluble portion 3*a* and the soluble portion 3*b*, ultraviolet light is exposed through a photo mask. Further, when the photoresist 3 is of a chemical amplification type, PEB (Post Exposure Bake) is carried out after the exposure.

Next, in FIG. 1(*b*), after the process described in FIG. 1(*a*), without performing development, a light-absorbing body (positive type photosensitive material) 10 is formed. Then, a photo mask (mask pattern) 4*b* is arranged with registration so as to cover the upside of the soluble portion 3*b* and to catch on the upside of the insoluble portion 3*a*, with respect to the photoresist 3.

In other word, the photo mask 4*b*, which is larger than the photo mask 4*a* arranged above the photoresist 3, is arranged above the face of the light-absorbing body 10 opposite to the face being in contact with the unexposed region of the photoresist 3. More specifically, the photomask 4*b* is arranged so as to cover the upside of the face opposite the face being in contact with the boundary between the unexposed region and the exposed region of the photoresist 3, with respect to the light-absorbing body 10. On this occasion, the photoresist 3 is arranged so that it covers the upside of the face opposite a face being in contact with the upper face of the photoresist 3 lying between from 1 μm to 500 μm from the boundary between the unexposed region and the exposed region in the direction toward the exposed region.

Then, after arranging the photo mask 4*b*, light is irradiated from above the photo mask 4*b*, and ultraviolet light 20*b* is irradiated through the photo mask 4*b* to the light-absorbing body 10. At this time, the soluble portion 3*b* is not irradiated by the ultraviolet 20*b*, because the upside of the portion is covered with the photo mask 4*b*.

In this connection, the thickness of the light-absorbing body 10 is sufficient when it is thicker than that of an electrode in an electrode-forming process described later, and is 20 μm or less. As for the light-absorbing body 10, a positive type photoresist is used, and a positive type resist of novolac-type resin is used. The formation method of the light-absorbing body 10 is spin coating or spray coating.

Next, in FIG. 1(*c*), development of the light-absorbing body 10 is carried out to remove the exposed region. In development of the light-absorbing body 10, an alkaline developer containing TMAH (tetramethylammonium hydroxide) is used. After the development, the light-absorbing body 10 has been formed so as to cover the upper face of the soluble portion 3*b* and to catch on a part of the upper face of the insoluble portion 3*a*.

Next, in FIG. 1(*d*), an electroconductive layer 5 is formed on the upper face of the insoluble portion 3*a* and the upper face of the light-absorbing body 10. The thickness of the electroconductive layer 5 is around from 5 nm to 10 μm, and is sufficient when it allows the layer to be conductive in an electroforming process described later. Material of the electroconductive layer 5 is gold (Au), silver (Ag), nickel (Ni) or the like, and chromium (Cr), titanium (Ti) or the like may be formed between the photoresist 3 and the electroconductive layer 5 as an anchor metal (not shown) for strengthening the adhesion force of the electroconductive layer 2. As for the formation method of the electroconductive layer 5, a vapor precipitation method such as a spattering method and a vacuum evaporation method, or a wet method such as electroless plating is used.

In this connection, in the case where the electroconductive layer 5 is formed by using a spattering method without forming a light-absorbing body 10, since the process uses plasma, the soluble portion 3*b* is also irradiated by ultraviolet light to make the soluble portion 3*b* insoluble in a development process described later. However, in the invention, since the light-absorbing body 10 is formed on the soluble portion 3*b*, the ultraviolet light is absorbed by the light-absorbing body 10 upon forming the electroconductive layer 5 by a spattering method and the ultraviolet light is not irradiated to the soluble portion 3*b*. Further, since the light-absorbing body 10 is constituted of a positive type photoresist, it has such nature that it becomes easily soluble when irradiated by ultraviolet light. Accordingly, in a liftoff process described later, the light-absorbing body 10 can be removed easily.

Next, in FIG. 1(*e*), the light-absorbing body 10, and at the same time the electroconductive layer 5 on the light-absorbing body 10, are removed in an alkaline developer. This gives patterned electrodes 5*a*. The alkaline developer used in the process has a concentration equal to or more than that of the developer described in FIG. 1(*c*), and preferably one having a twice or more concentration is used.

Next, in FIG. 1(*f*), a photoresist 6 is formed on the upper face of the electrode 5*a* and the upper face of the soluble portion 3*b* and the upper face of the insoluble portion 3*a* exposed through the process in FIG. 1(*e*). Next, a photo mask (mask pattern) 4*c* is registered so as to cover the upside of the soluble portion 3*b* and to catch on the insoluble portion 3*a*. That is, the photo mask 4*c* is arranged so as to expose a part of the upper portion of the face being in contact with the electroconductive layer 5 with respect to the photoresist 6. More specifically, a photo mask 4*c*, which is larger than the photo mask 4*b* arranged above the light-absorbing body 10, is arranged so that it is positioned above the face opposite the face being in contact with the unexposed region of the photoresist 3.

Then, after arranging the photomask 4*c*, ultraviolet light 20*a* is irradiated to carry out exposure, followed by developing to form an insoluble portion 6*a* and a soluble portion 6*b*.

Thickness of the photoresist 6 is around from 1 μm to 5 mm, and is approximately equal to that of a second step of an electroformed object to be formed. As for the photoresist 6, a negative type photoresist is used. Further, the photoresist 6 may be a chemical amplification type photoresist. When producing a structure with a high aspect ratio, as a photoresist 6, desirably an epoxy-type resin-based chemical amplification type photoresist is used. In this connection, the material of the photoresist 6 is desirably the same as that of the photoresist 3, because they can be developed with the same developer in a development process described later, but a material different from that of the photoresist 3 may be used. A formation method of the photoresist 6 is spin coating, dip coating or spray coating, or a photoresist film in sheet may be stuck onto the electroconductive laser 5. Further, plural photoresist films in sheet may be laminated to give a photoresist 6 having an intended thickness. In order to form an insoluble portion 6*a* and a soluble portion 6*b*, ultraviolet light 20*a* is exposed through the photo mask 4*c*. Further, when the photoresist 6 is of a chemical amplification type, PEB (Post Exposure Bake) is carried out after the exposure.

Next, in FIG. 1(*g*), development is carried out to remove the soluble portions 3*b* and 6*b*. The development is practiced by dipping the substrate having the photoresist 3 and the photoresist 6 in FIG. 1(*f*) in a developer.

According to the above-described process, the electroforming mold 101, which includes the first electroconductive layer 2 formed on the substrate 1, the first negative type photosensitive material 3 that is formed on the face of the first electroconductive layer 2 opposite the face being in contact with the substrate 1 and has the through-hole 24 in the thickness direction, the second electroconductive layer 5 formed on a part of the face of the first negative type photosensitive material 3 opposite the face being in contact with the first electroconductive layer 2, and the second negative type photosensitive material 6 that is formed on a part of the face of the second electroconductive layer 5 opposite the face being in contact with the first negative type photosensitive material 3 and has the second through-hole 25 above the face including the aperture face of the first through-hole 24 with respect to the upper face of the first negative type photosensitive material 3, is obtained.

Figure 4:
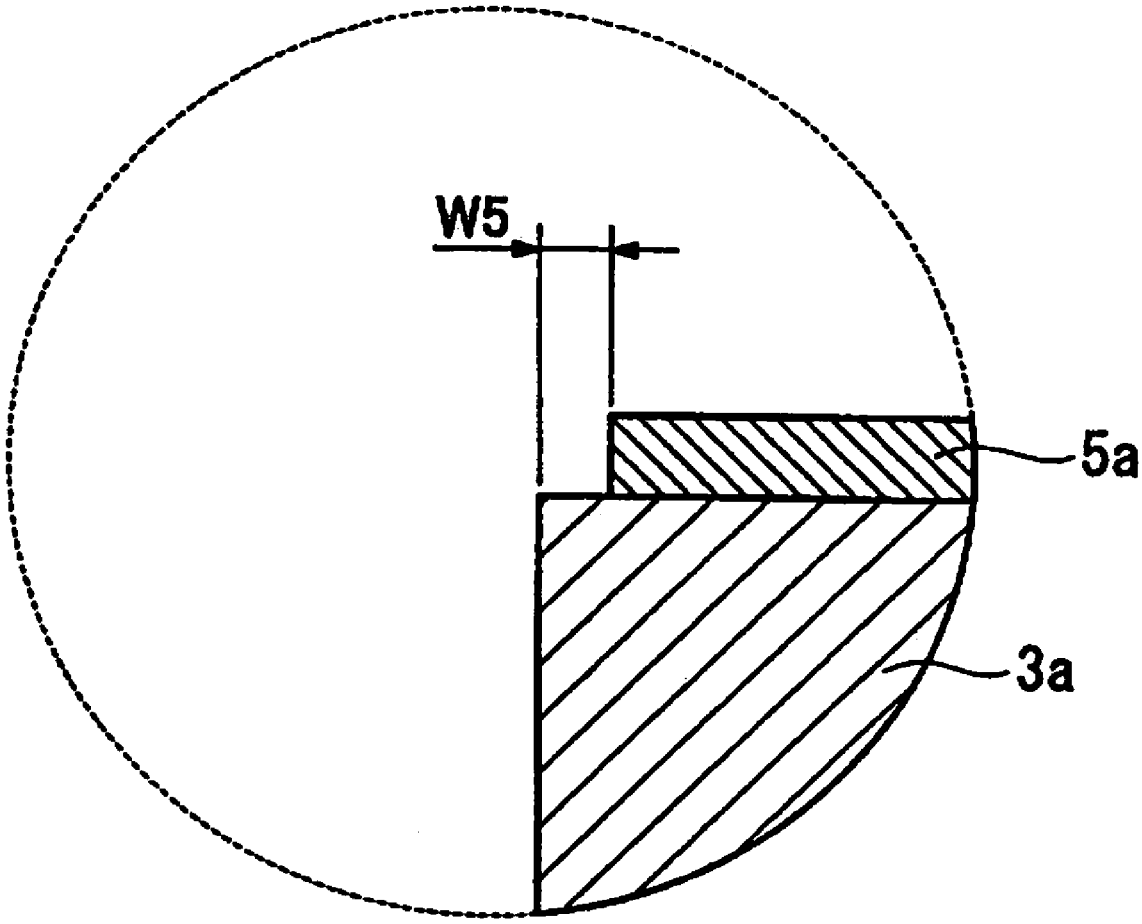
FIG. 4 is an enlarged drawing of a portion shown as A in FIG. 1(*g*).
Figure 5A:
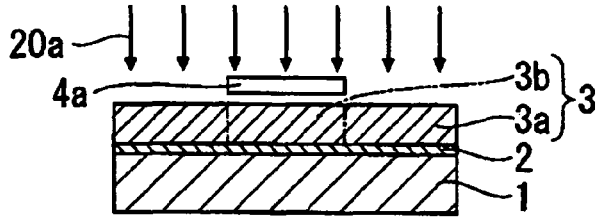
FIG. 5 is a drawing showing the method for manufacturing an electroforming mold in a second embodiment.
Figure 5B:
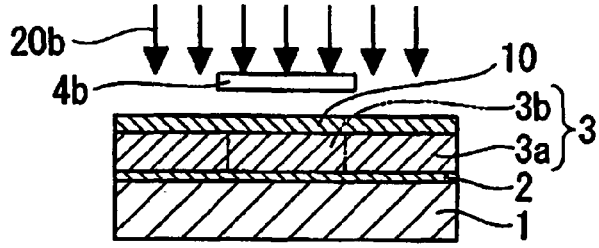
Figure 5C:
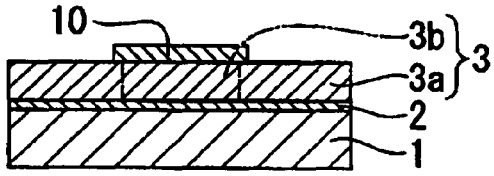
Figure 5D:
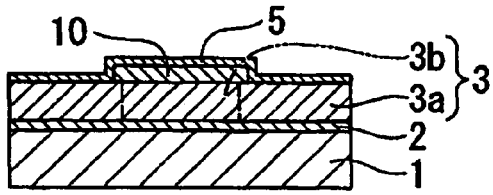
Figure 5E:
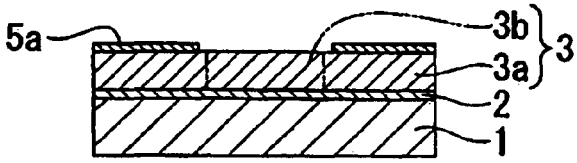
Figure 5F:
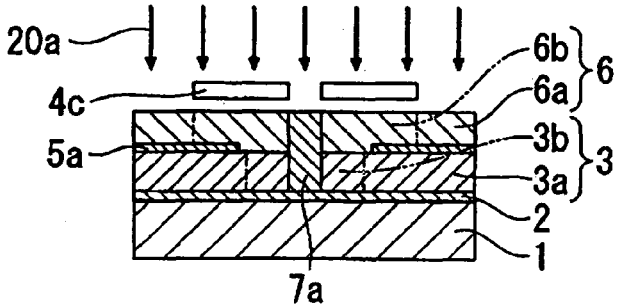
Figure 5G:
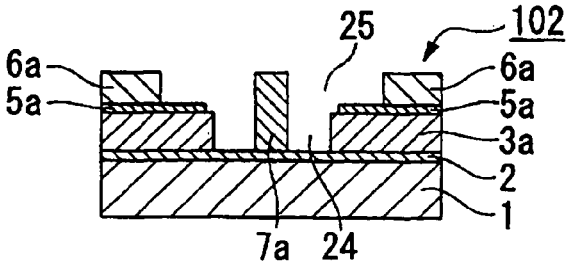
Figure 6A:
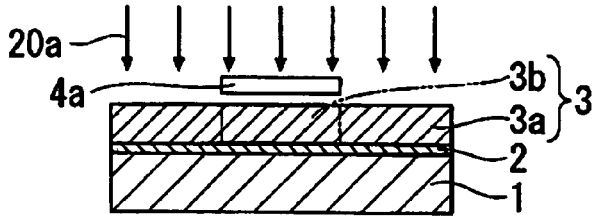
FIG. 6 is a drawing showing the method for manufacturing an electroforming mold in a third embodiment.
Figure 6B:
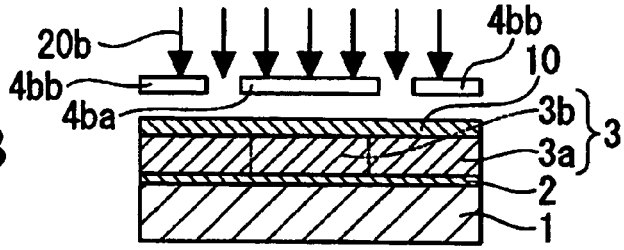
Figure 6C:
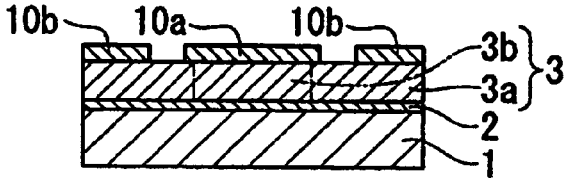
Figure 6D:
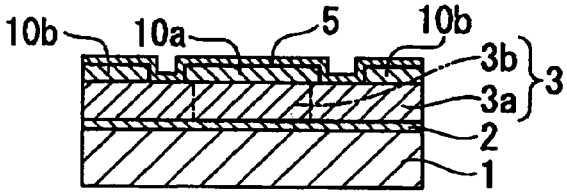
Figure 6E:
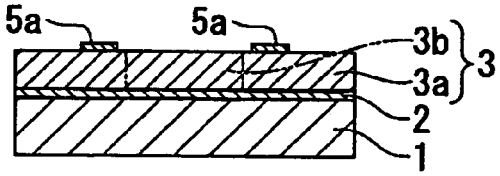
Figure 6F:
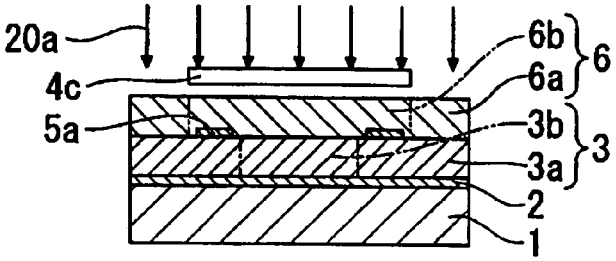
Figure 6G:
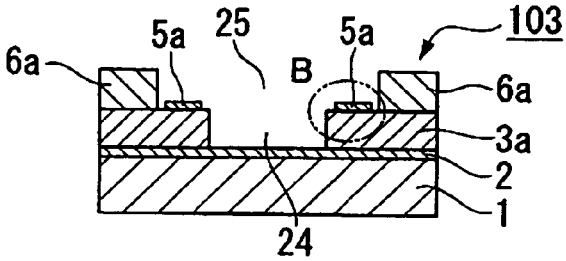

The second through-hole 25 is formed above the face including the edge portion of the aperture face of the first through-hole 24 with respect to the upper face of the photoresist 3 so that the second through-hole 25 overlies and completely exposes both the first through-hole 24 and a peripheral part of the elecroconductive layer 5 that surrounds the first through-hole 25. That is, they are in such positional relation that, when the second through-hole 25 is viewed from above, the first through-hole 24 is positioned within and completely exposed by the second through-hole 25. Further, since the arrangement is so that, when the photo mask 4*b* is arranged, the mask 4*b* covers the upside of the soluble portion 3*b* as well as catches on a part of the insoluble portion 3*a*, the electroconductive layer 5 is formed so as to have an edge portion formed apart from the face forming the first through-hole 24, i.e., the electroconductive layer 5 is spaced from the edge of the first through-hole 24. That is, as shown in FIG. 4 (magnified drawing of the A portion shown in FIG. 1), the figure is so that the electrode 5*a* on the insoluble portion 3*a* is recessed from the edge face of the insoluble portion 3*a*. Incidentally, width W5 of the recessed portion of the electrode 5*a* is 1 μm or more.

As for combination of the photosensitive materials, as mentioned above, it is preferred that the photoresist 3 and the photoresist 6 are negative type photoresists and the light-absorbing body 10 is a positive type photoresist. Because, the region of the soluble portion 3*b* is not exposed in the exposure of the light-absorbing body 10 in FIG. 1(*b*) and, also in forming the electroconductive layer 5 in FIG. 1(*d*), ultraviolet light is absorbed by the light-absorbing body 10, thus the soluble portion 3*b* is not exposed. In exposure of the photoresist 6 in FIG. 1(*f*) also, the area of the soluble portion 3*b* is not exposed. Accordingly, a photoresist that has been exposed is not affected by a later exposure process.

In addition to the above-described combination of photosensitive materials, replacement of a negative type photoresist with a positive type photoresist with regard to the photoresist 3 and the photoresist 6 and replacement of a positive type photoresist with a negative type photoresist with regard to the light-absorbing body 10 also makes the operation possible.

Further, replacement of a negative type photoresist with a positive type photoresist with regard to the photoresist 3 and replacement of a positive type photoresist with a negative type photoresist with regard to the light-absorbing body 10 also makes the operation possible.

Figure 2:
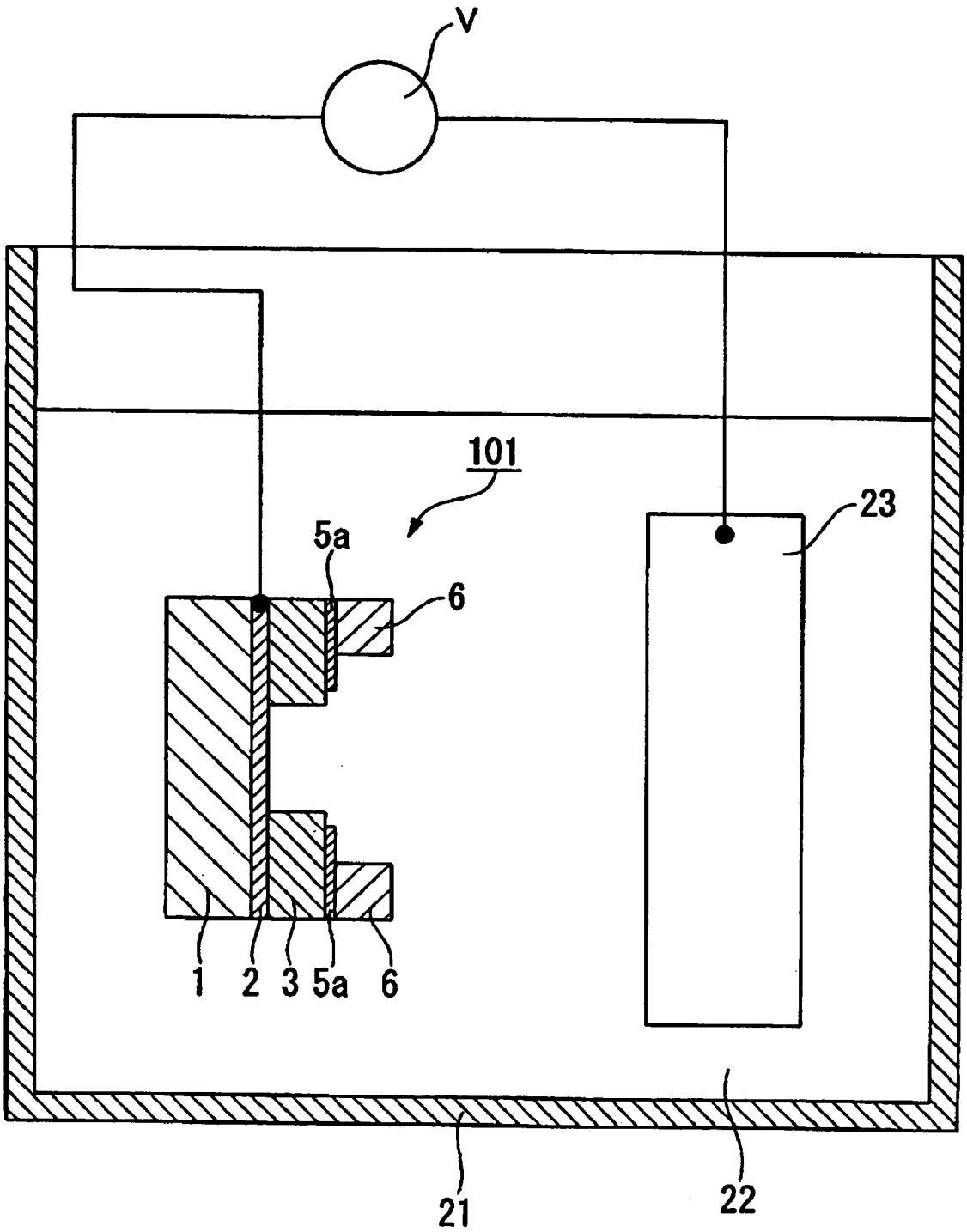
FIG. 2 is a drawing showing an electroforming method in the first embodiment.
Figure 3A:
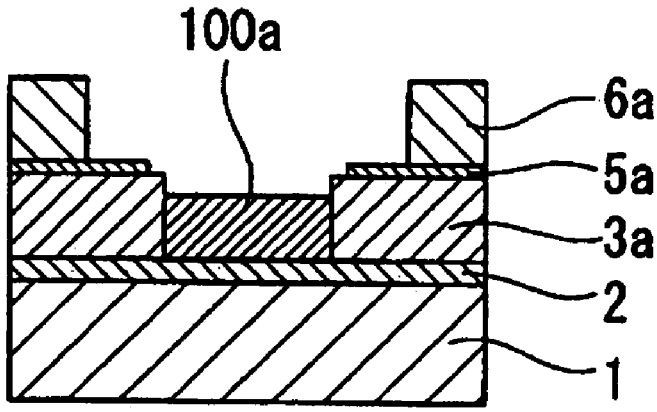
FIG. 3 is a drawing showing a process for producing an electroformed component in the first embodiment.
Figure 3B:
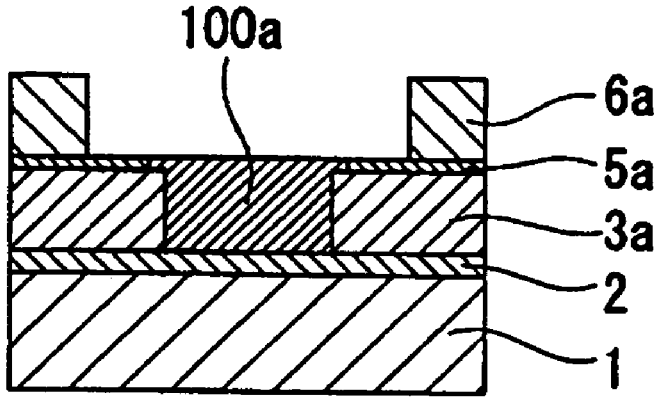
Figure 3C:
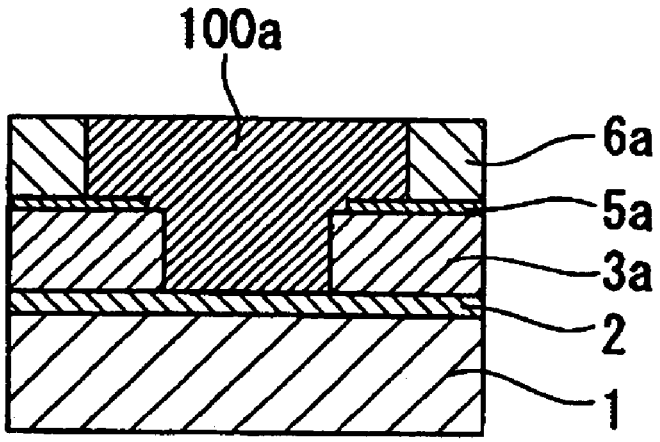
Figure 3D:
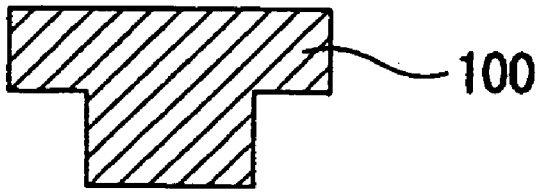

FIG. 2 is a drawing for illustrating an electroforming method upon forming an electroformed component 100 by using the electroforming mold 101 manufactured by the above-described manufacturing method.

An electroforming tank 21 is filled with an electroforming liquid 22, and the electroforming mold 101 and an electrode 23 are dipped in the electroforming liquid 22. The electroforming liquid 22 varies depending on a metal to be precipitated and, for example, an aqueous solution containing nickel sulfamate hydrated salt is used when nickel is intended to be precipitated. Material of the electrode 23 is substantially the same material as a metal to be precipitated, thus nickel is employed when nickel is intended to be precipitated, and a nickel plate or a titanium basket containing nickel balls is used as the electrode 23.

In this connection, in the manufacturing method of the invention, a material to be precipitated is not limited to nickel. The method can be applied to all the materials capable of electroforming, such as cupper (Cu), cobalt (Co) and tin (Sn). The electroconductive layer 2 of the electroforming mold 101 is connected to a power source V. By supply of electrons through the electroconductive layer 2 by the voltage of the power source V, a metal is precipitated gradually from the electroconductive layer 2. The precipitated metal grows in the thickness direction of the substrate 1.

FIG. 3 is a drawing illustrating a process for manufacturing an electroformed component 100 by using the electroforming mold 101 according to a first embodiment of the invention.

In FIG. 3(*a*), onto the upper face of the electroconductive layer 2 exposed by the electroforming method described in FIG. 2, an electroformed object (metal) 100*a* is precipitated. At this time, since no current flows to an electrode 5*a*, no precipitation of the electroformed object 100*a* occurs on the electrode 5*a*.

Next, in FIG. 3(*b*), the electroformed object 100*a* is allowed to grow up to the thickness of the insoluble portion 3*a*, and is further allowed to grow till it is brought into contact with the electrode 5*a*. On this occasion, since no current flows to the electrode 5*a* before the electroformed object 100*a* grows up to the thickness of the insoluble portion 3*a*, no electroformed object 100*a* is precipitated on the electrode 5*a*. However, when the electrode 5*a* and the electroformed object 100*a* are brought into contact with each other as shown in FIG. 3(*b*), since current begins to flow also to the electrode 5*a*, the electroformed object 100*a* begins to be precipitated also on the electrode 5*a*. Here, at the moment when the electroformed object 100*a* is brought into contact with the electrode 5*a*, voltage of the power source or current may be varied so that the current density becomes constant.

Next, in FIG. 3(*c*), the electroformed object 100*a* is allowed to be precipitated up to an intended thickness. After precipitating the electroformed object 100*a* up to the intended thickness, the thickness of the electroformed object 100*a* is uniformed by a grinding process. Incidentally, when thickness control of the electroformed object 100*a* is possible in an electroforming process, no grinding process may be carried out.

Next, in FIG. 3(*d*), the electroformed object 100*a* is taken out of the electroforming mold 101 to give the electroformed component 100. The takeout of the electroformed object 100*a* may be carried out by dissolving the insoluble portion 3*a* and the insoluble portion 6*a* with an organic solvent, or by tearing off physically by applying a force to the electroformed object 100*a* so as to separate it from the substrate 1. Further, if the mold is not reused, the mold may be destroyed to take out the electroformed object 100*a*. When the electroconductive layer 2 and the electrode 5*a* attach to the electroformed object 100*a*, they are removed by using such method as a wet etching or polishing. Incidentally, when attachment of the electroconductive layer 2 or the electrode 5*a* brings about no problem against the function of the component, the electroconductive layer 2 and the electrode 5*a* may not be removed. Further, when the electroconductive layer 2 or the electrode 5*a* is necessary from the viewpoint of the function of the component, the electroconductive layer 2 or the electrode 5*a* is not removed.

Embodiment 2

FIG. 5 is a drawing illustrating an electroforming mold 102 and a method for manufacturing the same according to a second embodiment of the invention. In this connection, in the second embodiment, the same parts as the constituent elements in the first embodiment are given the same symbol and description about them is omitted.

First, in FIG. 5(*a*), an electroconductive layer 2 is formed on the upper face of the substrate 1, then a photoresist 3 is formed on the upper face of the electroconductive layer 2, followed by registering a photo mask 4*a* above a portion for forming a soluble portion 3*b* and by irradiating ultraviolet light 20*a* to perform exposure, thereby forming the insoluble portion 3*a* and the soluble portion 3*b*. Here, as the photoresist 3, a negative type photoresist is used.

Next, in FIG. 5(*b*), after the process described in FIG. 5(*a*), a light-absorbing body 10 is formed without carrying out development. In the Example, as the light-absorbing body 10, a positive type photoresist is used. Next, a photo mask 4*b* is registered so that it covers the upside of the soluble portion 3*b* and catches on the upside of the insoluble portion 3*a* with respect to the photoresist 3, ultraviolet light 20*b* is irradiated from above the photomask 4*b*, thereby irradiating the ultraviolet light 20*b* to the light-absorbing body 10 through the photo mask 4*b*. At this time, since the upside of the soluble portion 3*b* is covered with the photo mask, the ultraviolet light 20*b* is not irradiated to it.

Next, in FIG. 5(*c*), the light-absorbing body 10 is developed to remove the exposed region. In developing the light-absorbing body 10, an aqueous alkaline developer containing TMAH (tetramethylammonium hydroxide) is used. As the result of the development, the light-absorbing body 10 has been formed so that it covers the upper face of the soluble portion 3*b* and catches on a part of the upper face of the insoluble portion 3*a*.

Next, in FIG. 5(*d*), an electroconductive layer 5 is formed on the upper face of the insoluble portion 3*a* and the upper face of the light-absorbing body 10. Next, in FIG. 5(*e*), the light-absorbing body 10 as well as the electroconductive layer 5 on the light-absorbing body 10 are removed in an alkaline developer.

Next, in FIG. 5(*f*), a photoresist 6 is formed on the upper face of the electrode 5*a* and the upper face of the soluble portion 3*b* and a part of the upper face of the insoluble portion 3*a* exposed in the process of FIG. 5(*e*). In the Example, as the photoresist 6, a negative type photoresist is used. Next, a photo mask 4*c* is registered above the portion for forming a soluble portion of the photoresist 6, and exposure is carried out to form a insoluble portion 6*a* and a soluble portion 6*b*, and an insoluble portion 7*a* that is to be formed while penetrating the photoresist 6 and soluble portion 3*b*. Next, in FIG. 5(*g*), by forming an insoluble portion 7*a* of the through-pattern by the second exposure process, the through-pattern 7*a* without registration failure of the second layer relative to the first layer can be formed.

As the result of the above-described process, the electroforming mold 102 that is the same as the electroforming mold 101 obtained in the first embodiment and has a through-pattern 7*a* formed in the through-holes 24 and 25 can be obtained. When an electroformed component is formed by using the electroforming mold 102, a hollow portion coaxial for respective stages is formed at the center.

Embodiment 3

FIG. 6 is a drawing illustrating an electroforming mold 103 and the method for manufacturing the same according to a third embodiment of the invention. In this connection, in the third embodiment, the same parts as the constituent elements in the first embodiment are given the same symbol and description about them is omitted.

First, in FIG. 6(*a*), the electroconductive layer 2 is formed on the upper face of the substrate 1, then the photoresist 3 is formed on the upper face of the electroconductive layer 2, followed by registering the photo mask 4*a* above a portion for forming an unexposed region that is a soluble portion 3*b* and by irradiating ultraviolet light 20*a* to carry out exposure, thereby forming the insoluble portion 3*a* that is the exposed region and the soluble portion 3*b* that is unexposed region. In the Example, as the photoresist 3, a negative type photoresist is used.

Next, in FIG. 6(*b*), the light-absorbing body 10 is formed on the upper face of the photoresist 3. In the Example, as the light-absorbing body 10, a positive type photoresist is used. Then, so as not to expose the soluble portion 3*b*, a photo mask (first mask pattern) 4*b* a is arranged above the light-absorbing body 10 while being registered so that it covers the region of the soluble portion 3*a* and also catches on the region of the insoluble portion 3*a*. In this connection, the photo mask 4*b* a may be arranged so that it covers the region of the soluble portion 3*b* alone, or may be arranged so that it not completely covers the region of the soluble portion 3*b*.

Further, so as not to expose the light-absorbing body 10 formed in a region for forming an insoluble portion 6*a* of a photoresist 6 in a process described later with respect to the photoresist 3, a photo mask (second mask pattern) 4*bb* is arranged above the light-absorbing body 10. On this occasion, the photo mask 4*bb* is arranged in a position separated from the photo mask 4*ba* so that it covers a region for forming an insoluble portion 6*a* described later and catches on a region for not forming the insoluble portion 6*a*. In this connection, the photo mask 4*ba* may be arranged so that it covers the region to be the insoluble portion 6*a* alone, or may be arranged so that it not completely covers the region to be the insoluble portion 6*a*.

Next, ultraviolet light 20*b* is irradiated from above the photo masks 4*ba* and 4*bb* to irradiate the ultraviolet light 20*b* to the light-absorbing body 10 through the photo masks 4*ba* and 4*bb*. At this time, the upside of the soluble portion 3*b* is covered with the photo mask 4*ba*, therefore the portion 3*b* is not irradiated by the ultraviolet light 20*b* and is not exposed.

Next, in FIG. 6(*c*), the light-absorbing body 10 is developed to remove the exposed region, thereby patterning the light-absorbing bodies 10*a* and 10*b* on the upper face of the photoresist 4. Since the photo mask 4*ba* is arranged so that it covers the region of the soluble portion 3*a* and catches on the region of the insoluble portion 3*a*, the light-absorbing body 10*a* is formed so as to cover the upper face of the soluble portion 3*b* and also to catch on a part of the upper face of the insoluble portion 3*a*.

In this connection, when the photo mask 4*ba* is arranged so as to cover the region of the soluble portion 3*b* alone, the light-absorbing body 10*a* is formed on the upper face of the soluble portion 3*b*, and, when it is arranged so as to cover the soluble portion 3*b* not completely, the light-absorbing body 10*a* is formed in such away that it covers up to the inner periphery of the boundary between the soluble portion 3*b* and the insoluble portion 3*a*.

On the other hand, the light-absorbing body 10*b* is formed in a region where the insoluble portion 6*a* of the photoresist 6 is formed in a process described later. Since the photo mask 4*bb* is arranged so that it covers the region for forming the insoluble portion 6*a* and catches on the region for not forming the insoluble portion 6*a*, the light-absorbing body 10*b* is formed so as to cover the face where the insoluble portion 6*a* is to be formed later and also to catch on a part of the face where the insoluble portion 6*a* is not to be formed.

In this connection, when the photo-mask 4*bb* is arranged so as to cover the region for forming the insoluble portion 6*a* alone, the light-absorbing body 10*b* is formed on the upper face of the face for forming the insoluble portion 6*a*, and, when the photo mask 4*bb* is arranged so as to cover the region for forming the insoluble portion 6*a* not completely, the light-absorbing body 10*b* is formed in such a way that it covers up to the portion slightly recessed from the boundary between the faces forming and not forming the insoluble portion 6*a* into the face side for forming the insoluble portion 6*a*.

Next, in FIG. 6(*d*), the electroconductive layer 5 is formed on the upper face of the photoresist 3 exposed in the process in FIG. 6(*c*) and the upper face of the light-absorbing body 10.

Next, in FIG. 6(*e*), the light-absorbing bodies 10*a* and 10*b*, as well as the electroconductive layer 5 on the light-absorbing bodies 10*a* and 10*b* are removed in an alkaline developer. As the result, electrodes 5*a* are patterned. The alkaline developer for use in the process is one having concentration equal to or higher than that of the developer described in FIG. 6(*c*), and, preferably, one having twice or higher concentration.

Next, in FIG. 6(*f*), the photoresist 6 is formed on the upper face of the electrode 5*a* and on the upper face of the photoresist 3 exposed in the process in FIG. 6(*e*). Then a photo mask 4*c* is arranged so that it covers the soluble portion 3*b* and the electrode 5*a* and catches on the region of the insoluble portion 3*a* where the electrode 5*a* has not been formed. The photo mask 4*c* may be arranged so as to cover the edge portion of the electrode 5*a* on the soluble portion 3*b* side, or arranged so as to cover the region up to the edge portion of the electrode 5*a* on the insoluble portion 3*a* side, or arranged while not completely covering the region of the electrode 5*a*. In the Example, as the photoresist 6, a negative type photoresist is used.

Then, the ultraviolet light 20*a* is irradiated from above the photo mask 4*c* and, through the photo mask 4*c*, the ultraviolet light 20*a* is irradiated to the photoresist 6, thereby forming the insoluble portion 6*a* that is the exposed region and the soluble portion 6*b* that is an unexposed region.

Next, in FIG. 6(*g*), development is carried out to remove the soluble portions 3*b* and 6*b*. The development is practiced by dipping the substrate having the photoresist 3 and the photoresist 6 in FIG. 6(*f*) in a developer.

As the result of the above-described process, the electroforming mold 103, which includes the substrate 1, the first electroconductive layer 2 formed on the upper face of the substrate 1, the first negative type photosensitive material 3 that is formed on the upper face of the first electroconductive layer 2 and has the first through-hole 24 in the thickness direction, the second negative type photosensitive material 6 that is formed on a part of the upper face of the first negative type photosensitive material 3 and has the second through-hole 25 passing through in the thickness direction above the first through-hole 24, and the second electroconductive layer 5 that is formed within the second through-hole 25 and on the upper face of the first negative type photosensitive material 3 wherein the second electroconductive layer 5 is formed while being separated relative to the second negative type photosensitive material 6 by a predetermined distance W6, is obtained. One end (lower end) of the first through-hole 24 exposes the first electroconductive layer 2 and the side of the through-hole 25 exposes the first negative type photosensitive material 3.

Figure 7:
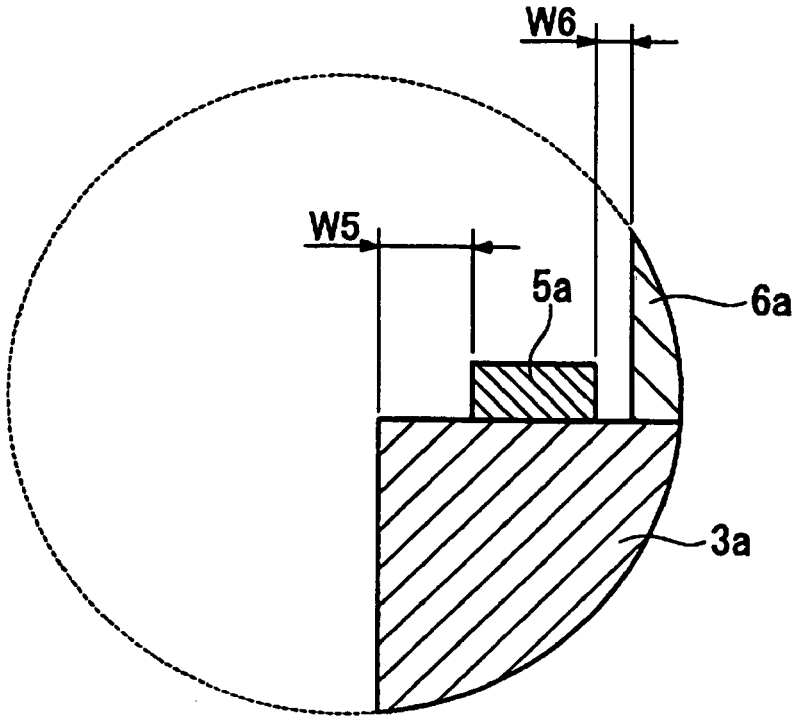
FIG. 7 is an enlarged drawing of a portion shown as B in FIG. 6(*g*).

Here, FIG. 7 is an enlarged drawing of B portion shown in FIG. 6. In the third embodiment, in the process in FIG. 6(*f*), the electrode 5*a* is arranged while being separated from the insoluble portion 6*a* by a predetermined distance W6 as shown in FIG. 7, because the photo mask 4*c* was arranged so as to cover the soluble portion 3*b* and the electrode 5*a* and, in addition, to catch on the region of the insoluble portion 3*a* where the electrode 5*a* has not been formed. As illustrated in FIGS. 6(*g*) and 7, the second electroconductive layer 5 is formed on a peripheral part of the upper face of the first negative type photosensitive material 3 and is spaced from both the edge of the first through-hole 24 and the second negative type photosensitive material 6.

As described above, when the electrode 5*a* is formed on the upper face of the insoluble portion 3*a* in a state of being separated from the insoluble portion 6*a* so as not to be brought into contact with the insoluble portion 6*a*, the insoluble portion 3*a* and the insoluble portion 6*a* are brought into contact directly with each other. Since both of the insoluble portion 3*a* and the insoluble portion 6*a* are made of photoresist materials, affinity is high to make the degree of adhesion high. Therefore, it becomes possible to connect the insoluble portion 3*a* and the insoluble portion 6*a* strongly, thereby giving the electroforming mold 103 with high strength.

Further, in the third embodiment, in the process in FIG. 6(*b*), the photo mask 4*ba* is arranged above the light-absorbing body 10 while registering so as to cover the region of the soluble portion 3*b* and also to catch on the region of the insoluble portion 3*a*, therefore, as shown in FIG. 7, the electrode 5*a* is arranged in a state of being recessed from the edge face of the insoluble portion 3*a* (that is, an aperture edge of the first through-hole 24) by W5 (in a state separated by a constant distance W5).

When the edge portion of the electrode 5*a* lies in the same plane as the edge face of the insoluble portion 3*a*, electric field concentrates on the edge portion of the upper face of the electrode 5*a*, which could lead to formation of an electroformed object with an increased thickness at the portion, but, by arranging it so as to recess from the edge face of the insoluble portion 3*a* by W5, it is possible to prevent concentration of the electrolysis and to allow the object to grow in a uniform thickness. Further, when the edge portion of the electrode 5*a* projects beyond the edge portion of the insoluble portion 3*a*, generation of curvature of the electrode 5*a* due to stress or formation of a "hollow" in the lower portion of the projecting electrode 5*a* during the electroforming could be lead, but, since it is arranged while being recessed from the edge portion of the insoluble portion 3*a* by W5, it is possible to prevent the "hollow" from being formed.

However, it is sufficient for the electrode 5*a* that it is formed on the insoluble portion 3*a* and has an exposed face, and position to be formed is not restricted. Accordingly, one edge of the electrode 5*a* may lie in the same plane as the edge face of the insoluble portion 3*a*, or may project beyond the edge face of the insoluble portion 3*a*. Further, the other edge of it may be in contact with the insoluble portion 6*a*.

Figure 8:
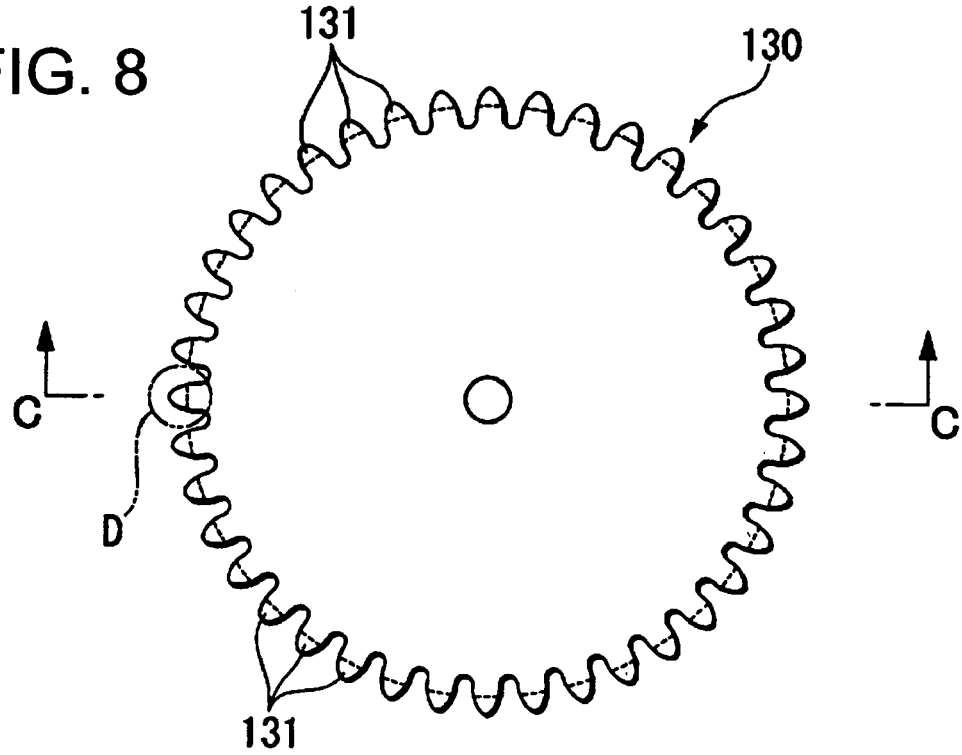
FIG. 8 is a drawing showing a gear (electroformed component) manufactured by using the electroforming mold shown in FIG. 6.

Here, the electroforming mold 103 according to the embodiment will be described more specifically. For example, description will be given as an electroforming mold for use in manufacturing the gear 130 shown in FIGS. 8 to 10 as a cast component.

That is, the electroforming mold 103 in this case is formed so as to have a circular outer shape to surround the circumference of the gear 130, and the second through-hole 25 formed in the photoresist 6 constitutes the outer shape of the gear 130 when viewed from above. Further, the first through-hole 24 formed in the photoresist 3 is configured in such a shape that it can make a step 131*a* on the front edge side of plural cog portions 131.

In doing so, as shown in FIGS. 10 and 11, the gear 130, in which the front edge of respective cog portions 131 is formed in a two-step figure with saved weight, can be manufactured by electroforming, thereby inertia moment at rotation can be reduced as far as possible when the gear 130 is rotated.

Figure 13:
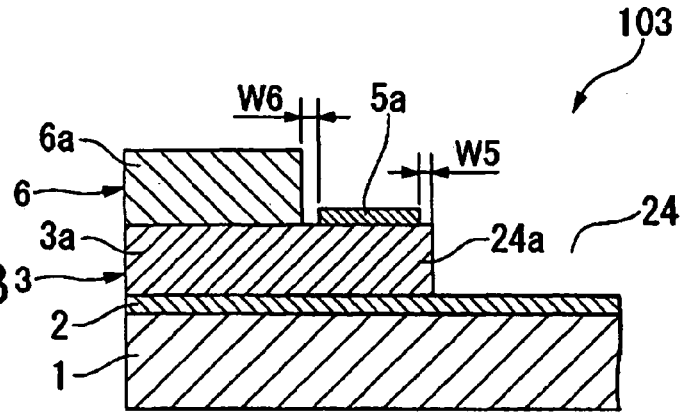
FIG. 13 is a cross sectional side view with respect to the arrows E-E shown in FIG. 12.

In the electroforming mold 103 for manufacturing such gear 130, in order to electroform respective cog portions 131 shown in FIG. 11 effectively, as shown in FIGS. 12 and 13, the electrode 5*a* configured by dividing and patterning the electroconductive layer 5 is formed on each of the photoresists 3 for generating the step of respective cog portions 131. On this occasion, the electrode 5*a* is formed so as to be separated from the photoresist 6 by a predetermined distance W6 (for example, 1 μm to 30 μm), and so as to be in a state of being not in contact with the photoresist 6. Further, the electrode 5*a* is formed so as to be also separated from the aperture edge 24*a* of the first through-hole 24 by a constant distance W5.

In other words, when the electroforming mold 103 is viewed from above, as shown in FIG. 12, there is such a state that the electrode 5*a* is pattered so as to become one size smaller two-dimensionally than the exposed pattern of the photoresist 3. In doing so, upon manufacturing the gear 130 by electroforming, it is possible to prevent a "streak" in a line from being formed on the outer surface of the gear 130. On this point, detailed description will be given hereinafter.

First, as shown in FIGS. 6(*e*) and 6(*f*), in the manufacturing method according to the invention, a process order is adopted, in which, after patterning the electrode 5*a* on the photoresist 3, the photoresist 6 is further formed on the photoresist 3 and the electrode 5*a*, and the photoresist 6 is exposed while utilizing the photo mask 4*c*.

Figure 14:
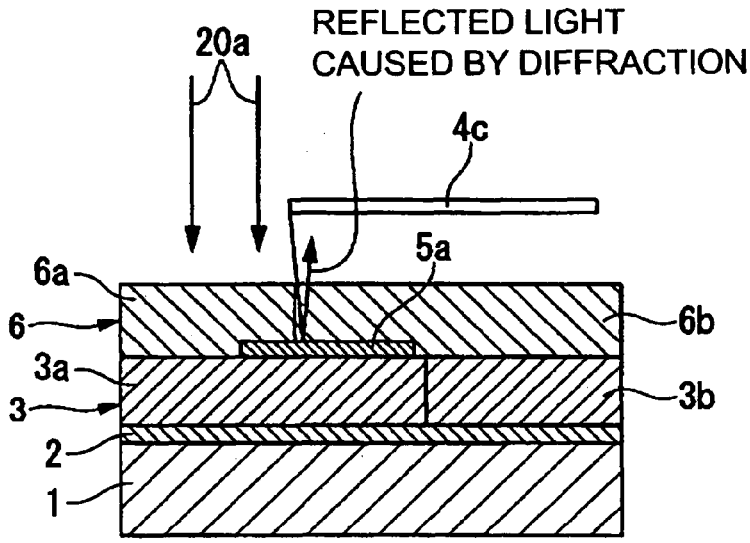
FIG. 14 is a process drawing upon manufacturing a gear by using an electroforming mold in which an electrode is in contact with a photoresist.

On this occasion, if, as shown in FIG. 14, the electrode 5*a* patterned on the photoresist 3 is formed in such a manner that it is in contact with the photoresist 6 (in FIG. 14, although the case where it is formed so as to hide under the lower side of the photoresist 6 is shown, the same applies to the case of simple contact), upon exposing the photoresist 6 by utilizing the photomask 4*c*, such phenomenon occurred that the ultraviolet light 20*a* is reflected from the electrode 5*a*.

That is, there occurred such problem that the irradiated ultraviolet light 20*a* not only exposes the region of the photoresist 6 that is not hidden by the photo mask 4*c* to form the insoluble portion 6*a*, but a part of the ultraviolet light) 20*a* having transmitted through the photoresist 6 is reflected from the electrode 5*a*, thereby also exposing a part of the region hidden by the photo mask 4*c* (a region for forming the soluble portion 6*b*). Particularly, since the ultraviolet light 20*a* passing nearby the edge portion of the photomask 4*c* is diffracted by the edge portion to vary the incident angle, after being reflected from the electrode 5*a*, it easily exposed the region hidden by the photo mask 4*c*.

Consequently, it was intended, by the photo mask 4*c*, to form the insoluble portion 6*a* and the soluble portion 6*b* surly in an intended position while clearly sectionalizing the regions of the photoresist 6 to which the ultraviolet light 20*a* is exposed or unexposed, but the insoluble portion 6*a* was also formed in an unintended region. As the result, when the photoresist 6 was developed to remove the soluble portion 6*b*, for example, a convex portion in a line had been formed needlessly on the edge portion of the insoluble portion 6*a*. Accordingly, when a metal was precipitated through electroforming, a portion being in contact with the convex portion was concaved to manufacture a gear (electroformed component) 130 with a "streak" in a line on the outer surface thereof, as described above.

Figure 15:
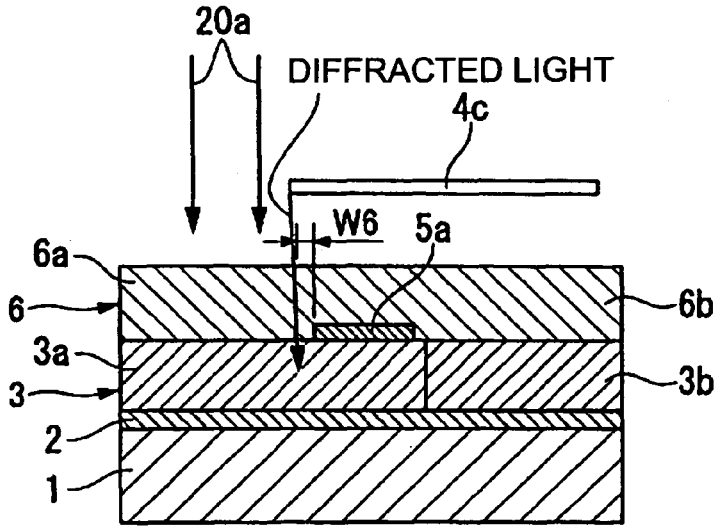
FIG. 15 is a process drawing upon manufacturing a gear by using an electroforming mold shown in FIG. 13 in which an electrode is separated relative to a photoresist.
Figure 16A:
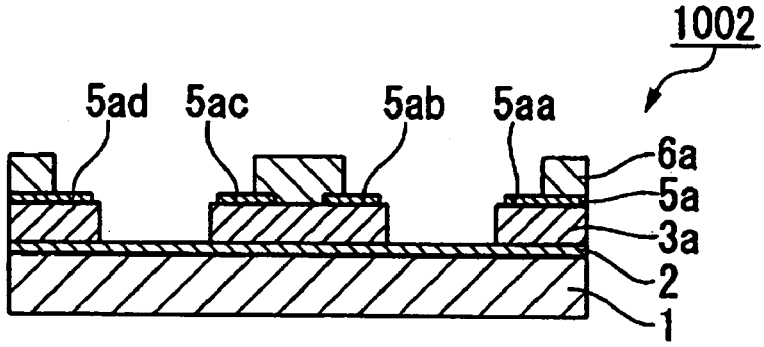
FIG. 16 is a drawing showing a process for producing an electroformed component in a fourth embodiment.
Figure 16B:
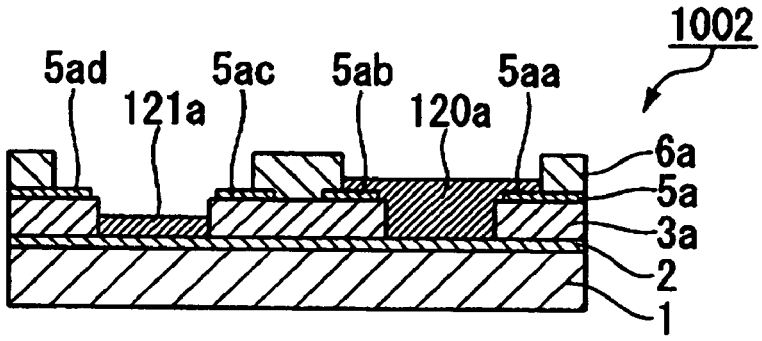
Figure 16C:
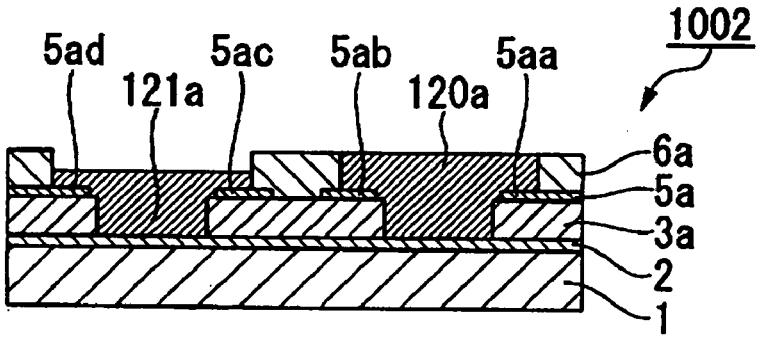
Figure 16D:
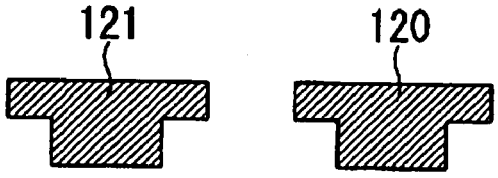

On the contrary, as shown in FIG. 15, when the electrode 5*a* is formed in such a state that it is separated from the photoresist 6 by a predetermined distance W6 and is not in contact with the photoresist 6, since the ultraviolet light 20*a* diffracted at the edge portion of the photo mask 4*c* upon exposing the photoresist 6 passes through the gap between the electrode 5*a* and the photoresist 6, there is no danger of reflection thereof from the electrode 5*a*. That is, generation of the reflected light from the electrode 5*a* can be controlled. Accordingly, it is possible to form the soluble portion bb and the insoluble portion 6*a* in the photoresist 6 in accordance with the regions sectionalized by the photo mask 4*c*, thus to eliminate generation of a needless insoluble portion 6*a* such as a convex portion in a line.

As the result, a gear 130, which has a smoothed outer surface without a "streak" and the like, can be manufactured surely by an electroforming. Particularly, the gear 130 falls in a state that the outer face thereof is ground every time it repeats engagement with other gear through the cog portion 131, but, since a smoothened outer surface without a "streak" can be formed, slide resistance can be reduced as far as possible. Accordingly, it is possible to rotate the gear 130 more smoothly, as well as to enhance endurance.

Further, since the electrode 5*a* is formed so as to be separated from the aperture edge 24*a* of the first through-hole 24 by a constant distance W5, when a metal is precipitated near the aperture edge 24*a*, the metal is not brought into contact with the electrode 5*a* without any delay, thereby preventing convergence of electric field and preventing precipitation of the metal in a distorted shape. This makes it easy to precipitate the metal in a uniform thickness surely, and possible to carry out electroforming in accordance with the electroforming mold 103.

In this connection, it is beneficial to set a predetermined distance W6 between the electrode 5*a* and the photoresist 6 based on the thickness of the photoresist 6. For example, when the thickness of the photoresist 6 is increased, since the irradiating light 20*a* diffracted at the photo mask 4*c* enters toward a more soluble portion 6*b* side till it passes through the photoresist 6, it is preferred to set the predetermined distance W6 to be larger, thereby widening the spacing between the electrode 5*a* and the photoresist 6. In doing so, it is possible surely to prevent the reflection light reflected from the electrode 5*a* from being generated.

Embodiment 4

FIG. 16 is a drawing illustrating an electroforming mold 1002 according to a fourth embodiment of the invention and a method for manufacturing electroformed components 120 and 121 using the same. In this connection, in the fourth embodiment, the same parts as the constituent elements in the first embodiment are given the same symbol and description about them is omitted.

The electroforming mold 1002 shown in FIG. 16(*a*) is an example in which plural electroforming molds according to the invention are horizontally arranged, wherein the mold is formed so as to have plural concave portions on the substrate 1. Here, electrodes 5*aa*, 5*ab*, 5*ac* and 5*ad* do not straddle respective convex portions and are formed independently from one another.

In FIG. 16(*b*), the electroformed objects (precipitated metal) 120*a* and 121*a* are precipitated by an electroforming method from above the exposed electroconductive layer 2. The electroformed objects 120*a* and 121*a* precipitated by the electroforming method do not necessarily have a uniform precipitation rate at respective concave portions. Therefore, as shown in FIG. 16(*b*), when comparing the electroformed object 120*a* with the electroformed object 121*a*, there may be such a case that the precipitation rate of the electroformed object 120*a* is larger than that of the electroformed object 121*a*. In this instance, since the electroformed object 120*a* is in contact with the electrodes 5*aa* and 5*ab*, electric current is flowing between the electrodes 5*aa* and 5*ab*. Accordingly, the electroformed object 120*a* is precipitated from the electrodes 5*aa* and 5*ab*. On the other hand, since the electroformed object 121*a* is not in contact with the electrodes 5*ac* and 5*ad*, no electric current flows between the electrodes 5*ac* and 5*ad*. Accordingly, no electroformed object 121*a* is precipitated on the electrodes 5*ac* and 5*ad*.

In FIG. 16(*c*), when the electroformed object 121*a* is brought into contact with the electrodes 5*ac* and 5*ad* as the result of progress of the electroforming, electric current flows between the electrodes 5*ac* and 5*ad*. This allows the electroformed object 121*a* to begin to be precipitated from the electrodes 5*ac* and 5*ad*.

As described above, since the electrodes 5*ab* and 5*ac* are separated from each other, each of the electrodes works only on the electroformed object 120*a* or 121*a* precipitated for the respective convex portions. Accordingly, even if the precipitation rate of the electroformed objects 120*a* and 121*a* at respective convex portions is not uniform, each of the electroformed objects 120*a* and 121*a* is precipitated independently and it is free of influence from the electroformed object 120*a* or 121*a* precipitated in the neighboring mold.

Lastly, in FIG. 16(*d*), the electroformed objects 120*a* and 121*a* are taken out of the electroforming mold 1002 to give the electroformed components 120 and 121.

Incidentally, when it is intended to make the electroformed object 120*a* and electroformed object 121*a* have the same intended thickness, thicknesses of the electroformed objects 120*a* and 121*a* are uniformed, for example, in a grinding process. Incidentally, when thickness control of the electroformed objects 120*a* and 121*a* is possible in the electroforming process, no grinding process may be carried out.

Here, in order to make a comparison with the electroforming mold 1002 shown in FIG. 16, precipitation of the electroformed objects 120*a* and 121*a* in the case where the electrodes 5*ab* and 5*ac* are not separated from each other and electrodes of the neighboring molds are linked will be described using FIG. 17.

Figure 17A:
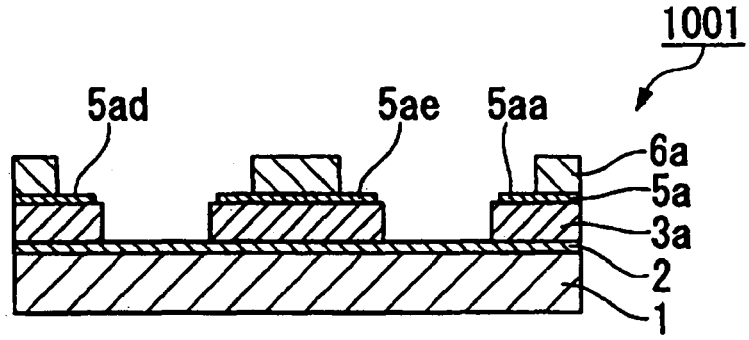
FIG. 17 is a drawing showing a Comparative example in the fourth embodiment.
Figure 17B:
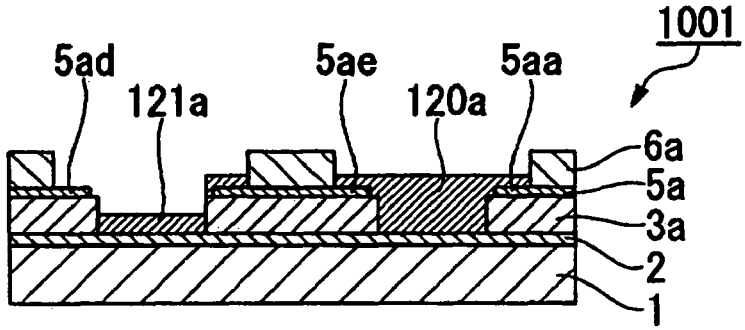
Figure 17C:
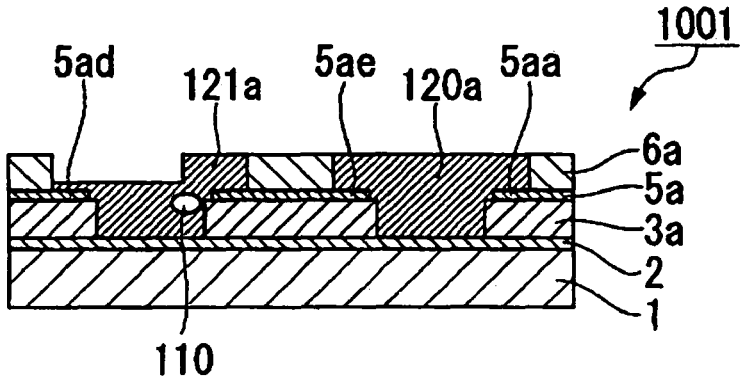

That is, as shown in FIG. 17(*a*), an electroforming mold 1001 is formed by integrating an electrode of a right side mold and an electrode of a left side mold as an electrode 5*ae*.

First, as shown in FIG. 17(*b*), the electroformed objects 120*a* and 121*a* are precipitated onto the upper face of the exposed electroconductive layer 2 by an electroforming method. In the case where the precipitation rates of the precipitated electroformed objects 120*a* and 121*a* are not uniform and the precipitation rate of the electroformed object 120*a* is larger than that of the electroformed object 121*a*, since the electroformed object 120*a* is in contact with the electrodes 5*aa* and 5*ae*, electric current flows between the electrodes 5*aa* and 5*ae*. Accordingly, from the electrode 5*ae*, the electroformed object is precipitated not only from the right edge but also from the left edge. On the other hand, since the electroformed object 121*a* has not been brought into contact with the electrode 5*ad* yet, no electric current flows through the 5*ad*. Therefore, in the left mold, the electroformed object 121*a* is precipitated from each of the electroconductive layer 2 and the electrode 5*ae* to make the precipitation uneven.

Further, as shown in FIG. 17(*c*), in the case where the electroformed objects 121*a* precipitated from each of the electroconductive layer 2 and the electrode 5*ae* further grow to be brought into contact with each other on the way, a "hollow" 110 may generate in the electroformed object 121*a*.

Accordingly, in the case where plural electroforming molds are configured to be arranged on the same substrate, when the electrodes of the neighboring electroforming molds are separated from each other as the electroforming mold 1002 shown in the fourth embodiment, the uniformly precipitated electroformed components 120 and 121 can be obtained.

Figure 18A:
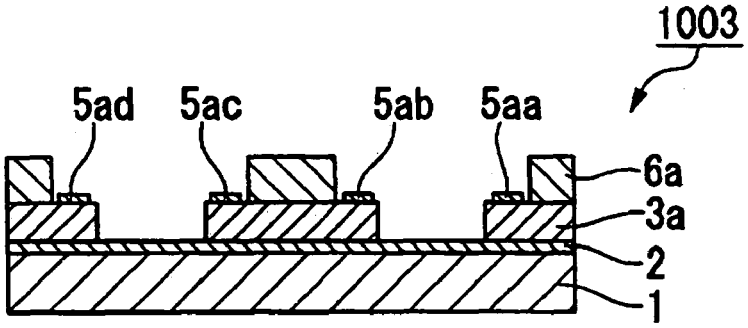
FIG. 18 is a drawing showing a modified Example in the fourth embodiment.
Figure 18B:
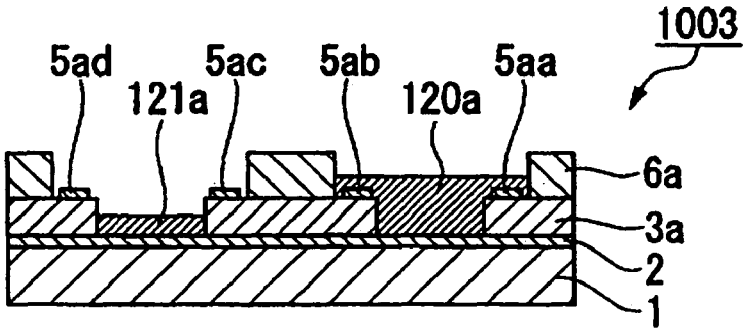
Figure 18C:
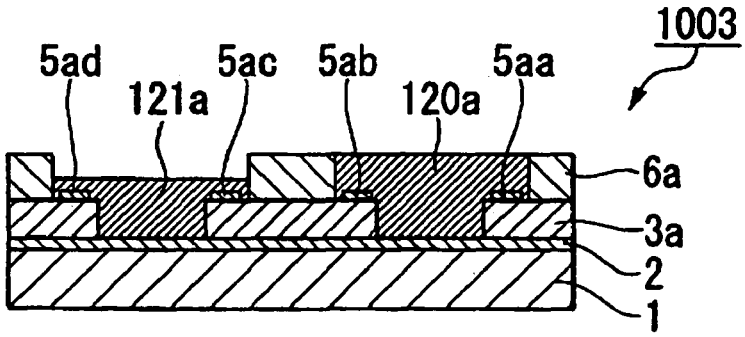
Figure 19A:
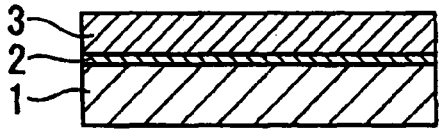
FIG. 19 is a drawing showing a process for producing an electroformed component in a fifth embodiment.
Figure 19B:
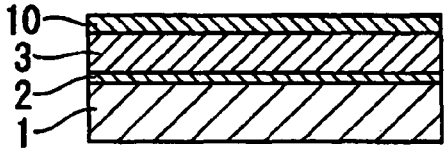
Figure 19C:
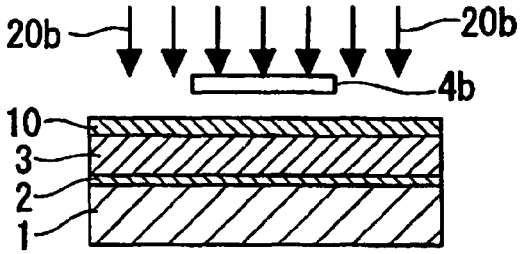
Figure 19D:
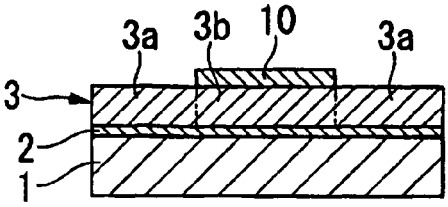
Figure 19E:
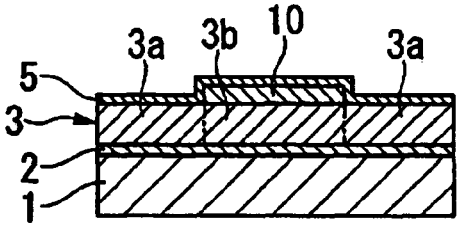
Figure 19F:
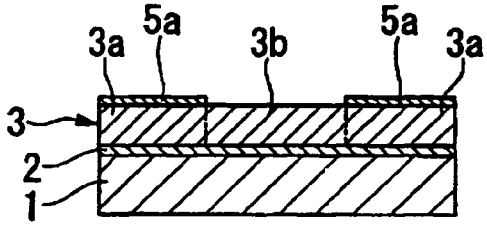
Figure 19G:
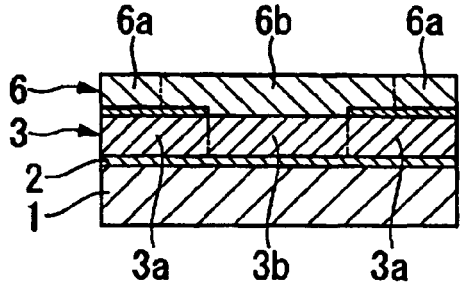
Figure 19H:
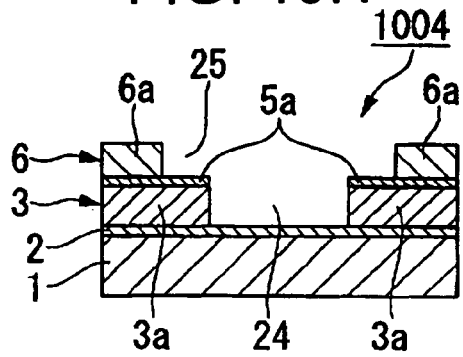
Figure 20A:
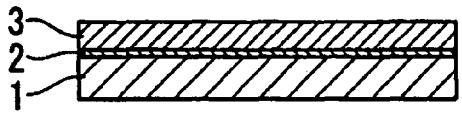
FIG. 20 is a drawing showing a process for producing an electroformed component in a sixth embodiment.
Figure 20B:
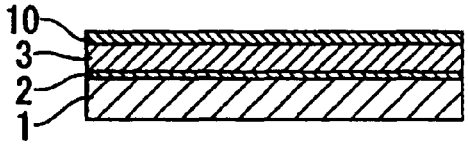
Figure 20C:
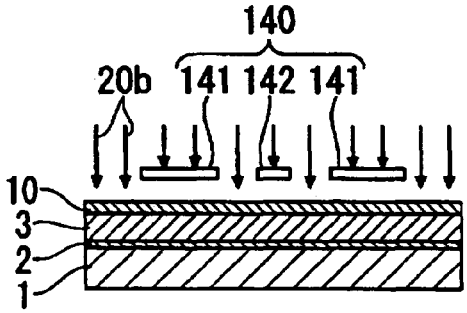
Figure 20D:
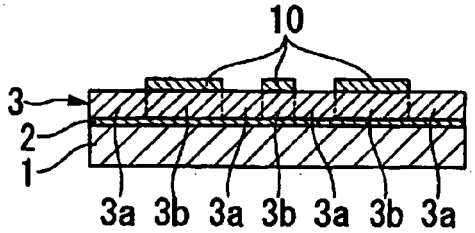
Figure 20E:
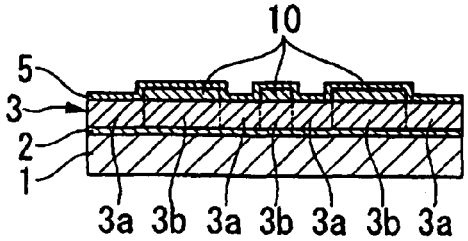
Figure 20F:
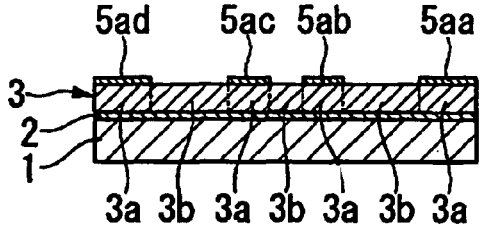
Figure 20G:
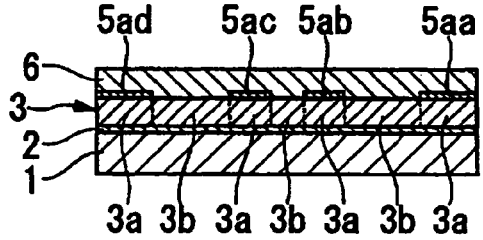
Figure 20H:
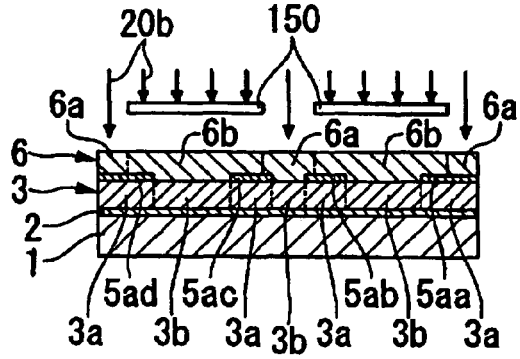
Figure 20I:
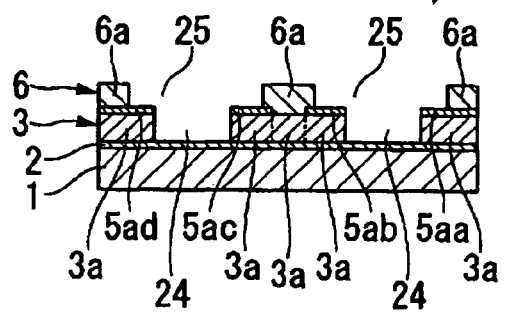
Figure 21A:
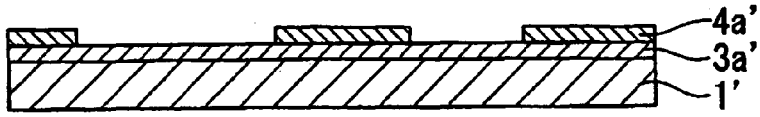
FIG. 21A PRIOR ART
FIG. 21 is a drawing showing a prior art.
Figure 21B:
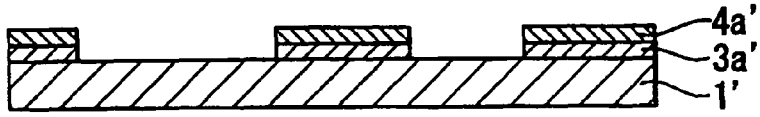
FIG. 21B PRIOR ART
Figure 21C:
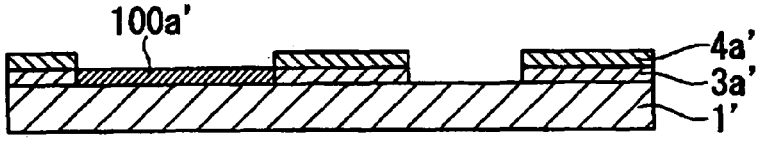
FIG. 21C PRIOR ART
Figure 21D:
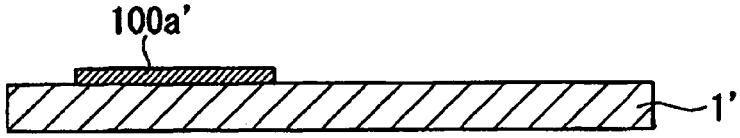
FIG. 21D PRIOR ART
Figure 21E:
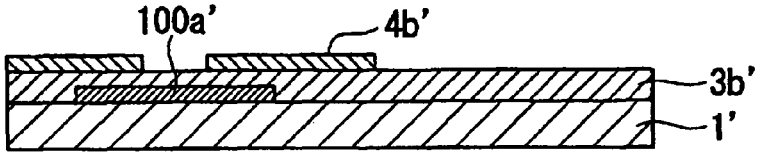
FIG. 21E PRIOR ART
Figure 21F:
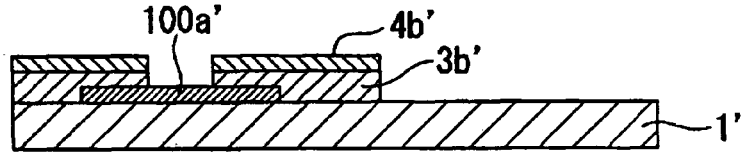
FIG. 21F PRIOR ART
Figure 21G:
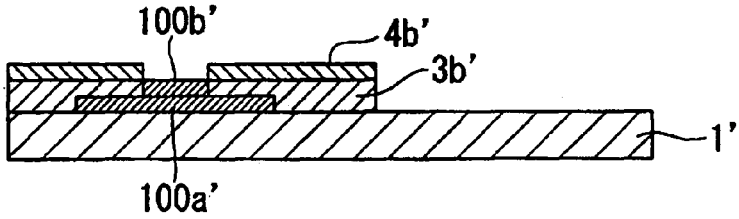
FIG. 21G PRIOR ART
Figure 21H:
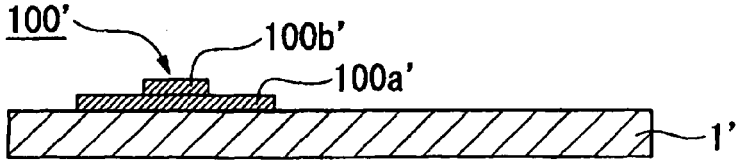
FIG. 21H PRIOR ART

An electroforming mold 1003 shown in FIG. 18(*a*) is a modified example of the electroforming mold and the method for manufacturing an electroformed component shown in FIG. 16 in which plural electroforming molds according to the invention are laterally arranged, wherein each of the electrodes 5*aa*, 5*ab*, 5*ac* and 5*ad* formed on the insoluble portion 3*a* are arranged while being separated from the insoluble portion 6*a*.

According to the electroforming mold 1003, as shown in FIG. 18(*b*), upon comparing the electroformed object 120*a* with the electroformed object 121*a*, even when the precipitation amount of the electroformed object 120*a* is faster relative to that of the electroformed object 121*a*, as shown in FIG. 18(*c*), since each of the neighboring molds can independently precipitate the electroformed objects 120*a* or 121*a*, uniformly precipitated electroformed components 120 and 121 can be obtained, as is the case for utilizing the electroforming mold 1002.

Accordingly, the case where each of the electrodes 5*aa*, 5*ab*, 5*ac* and 5*ad* is arranged while being separated from the insoluble portion 6*a* can also give the same effect as Example described in FIG. 16.

Embodiment 5

Next, fifth embodiment of the method for manufacturing an electroforming mold according to the invention will be described. In this connection, in the fifth embodiment, the same parts as the constituent elements in the first embodiment are given the same symbol and description about them is omitted.

A different point between the fifth embodiment and the first embodiment is the point that, in the first embodiment, each of the photo mask 3 formed on the electroconductive layer 2 and the light-absorbing body 10 formed on the photo mask 3 is exposed separately, but that, in the fifth embodiment, the photo mask 3 and the light-absorbing body 10 are exposed simultaneously.

In other words, the method for manufacturing an electroforming mold of the embodiment is a method in which a process of forming a film of the electroconductive layer 2 on the upper face of the substrate 1, a process of forming the photoresist 3 on the upper face of the electroconductive layer 2, and a process for forming the light-absorbing body 10 on the upper face of the photoresist 3 are carried out, and then a process for exposing the light-absorbing body 10 through the photo mask 4*b* arranged above the light-absorbing body 10 is carried out. The latter process is the same as that in the first embodiment.

Hereinafter, these respective processes are described in detail.

First, as shown in FIG. 19(*a*), on the upper face of the substrate 1 (having, for example, a thickness of around from 100 μm to 10 mm) such as glass or silicon, the electroconductive layer 2 and the photoresist 3 are formed in order.

On this occasion, the electroconductive layer 2 is made of, for example, gold, silver, nickel or the like and is formed by a spattering method, a vacuum evaporation method or the like. In this connection, between the electroconductive layer 2 and the substrate 1, chromium, titanium or the like, which is not shown, may be interposed as an anchor metal in order to strengthen the adhesion force of the electroconductive layer 2. Further, when an electroconductive substrate such as stainless steel and aluminum is adopted as the substrate 1, the electroconductive layer 2 is not necessarily required.

The photoresist 3 is a negative type photoresist, or a chemical amplification type photoresist, and is formed by spin coating or the like. Particularly, when a structure with a high aspect ratio is to be produced, as the photoresist 3, use of a chemical amplification type photoresist based on an epoxy-type resin is desirable. Further, as the photoresist 3, one which is insoluble in a developer of the light-absorbing body 10 is used.

After forming the electroconductive layer 2 and the photoresist 3, as shown in FIG. 19(*b*), the light-absorbing body 10 (having, for example, a thickness of 20 μm or less) is formed on the photoresist 3. The light-absorbing body is 10, a positive type photoresist of novolac-type resin, and is formed by spray coating or the like.

Then, as shown in FIG. 19(*c*), the photo mask 4*b* is arranged above the light-absorbing body 10 and, subsequently, the ultraviolet light 20*b* is irradiated from above through the photo mask 4*b* toward the light-absorbing body 10. In doing so, the photoresist 3 and the light-absorbing body 10 come into a state wherein a region not hidden by the photo mask 4*b* has been exposed by the ultraviolet light 20*b*. Incidentally, since the photoresist 3 is a negative type photoresist, the exposed region becomes the insoluble portion 3*b* not to be removed in the following development, and the region unexposed with the help of the photo mask 4*b* becomes the soluble portion 3*a* to be removed in the following development.

Subsequently, the light-absorbing body 10 alone is developed by using an alkaline developer containing, for example, TMAH (tetramethylammonium hydroxide). In this connection, when a chemical amplification type photoresist is used as the photoresist 3, it is subjected to PEB. Here, since the light-absorbing body 10 is of a positive type, the region exposed by the ultraviolet light 20*b* alone is removed. Accordingly, as shown in FIG. 19(*d*), a state is achieved in which only the region of the light-absorbing body 10 hidden under the photo mask 4*b* remains without being removed. Incidentally, a part of the photoresist 3 positioned under the light-absorbing body 10 becomes the soluble portion 3*b*.

Subsequently, as shown in FIG. 19(*e*), an electroconductive layer 5 (having, for example, a thickness of from 5 nm to 10 μm) is formed on the upper face of the insoluble portion 3*a* and the upper face of the light-absorbing body 10. On this occasion, the same as the above-described electroconductive layer 2, the electroconductive layer 5 is, for example, of gold, silver, nickel or the like and is formed by a spattering method, a vacuum evaporation method or the like. In this connection, between the electroconductive layer 5 and photoresist 3, chromium, titanium or the like, which is not shown, may be interposed as an anchor metal in order to strengthen the adhesion force of the electroconductive layer 3.

Then, as shown in FIG. 19(*f*), for example, in an alkaline developer, liftoff is carried out to remove both of the light-absorbing body 10 and the electroconductive layer 5 on the light-absorbing body 10. As the result, the electroconductive layer 5 is divided to give patterned electrodes 5*a*. Further, a state is achieved in which, with respect to the photoresist 3, the upper face of the soluble portion 3*b* is exposed.

Subsequently, as shown in FIG. 19(*g*), a photoresist 6 is formed on the upper face of the electrode 5*a* and the upper face of the exposed soluble portion 3*b*. Then, a photo mask, which is not shown, is arranged above the photoresist 6 and, subsequently, ultraviolet light, which is not shown, is irradiated from above through the photo mask toward the photoresist. On this occasion, the photo mask is arranged so as to hide the soluble portion 3*b* completely and, simultaneously, to hide a part of the insoluble portion 3*a*.

By the irradiation of ultraviolet light, a state is achieved in which, as shown in FIG. 19(*g*), a region of the photoresist 6 not hidden by the photo mask has been exposed. In this connection, since the photoresist 6 is a negative type photoresist, the exposed region becomes the insoluble portion 6*a* which is not to be removed in following development, and the unexposed region with the help of the photo mask becomes the soluble portion 6*b* which is to be removed in following development.

Lastly, the photoresists 3 and 6 are subjected to development to remove both of the insoluble portions 3*b* and 6*b* of the both photoresists 3 and 6. As the result, as shown in FIG. 19(*h*), an electroforming mold 1004, in which a first through-hole 24 is formed in the photoresist 3 and, at the same time, a second through-hole 25 is formed in the photoresist 6, can be manufactured.

As mentioned above, in the method for manufacturing an electroforming mold of the embodiment, different from the method described in the first embodiment, since the photoresist 3 and the light-absorbing body 10 are exposed at one time by a first irradiation of the ultraviolet light 20*b*, it is possible to reduce the number of the photo mask by one, as well as to reduce the process for arranging the photo mask by one process. Accordingly, the manufacturing time can be shortened and, simultaneously, the cost necessary for the photo mask can be lowered.

Further in the method according to the first embodiment, there was such requirement that, upon arranging the photomask 4*b* above the light-absorbing body 10, it must be registered on the basis of the position of the photomask 4*a* that had been arranged upon exposing the photoresist 3. This is done to allow the light-absorbing body 10 to be formed in a state of precise registration relative to the soluble portion 3*b* and the insoluble portion 3*a*.

On the contrary, in the embodiment, since the process in which the photoresist 3 is exposed by utilizing the photo mask 4*a* before forming the light-absorbing body 10 becomes unnecessary and the photoresist 2 and the light-absorbing body 10 can be exposed at one time, registration of the photomask 4*b* is unnecessary. Therefore, the manufacture becomes easier. Further, the insoluble portion 3*a* and the soluble portion 3*b* can be formed precisely at a targeted position, and the electroconductive layer 5 can be precisely divided according to an intended pattern to form the electrodes 5*a*. As the result, an electroformed component can be produced with high accuracy.

Embodiment 6

Next, a sixth embodiment of the method for manufacturing an electroforming mold according to the invention will be described. In the sixth embodiment, description will be given while exemplifying a case where an electroforming mold for use in the fourth embodiment is manufactured by the same manufacturing process as that in the aforementioned fifth embodiment.

In this connection, in the sixth embodiment, the same parts as the constituent elements in the fourth embodiment are given the same symbol and description about them is omitted.

First, as shown in FIG. 20(*a*), the electroconductive layer 2 and the photoresist 3 are formed on the upper face of the substrate 1 in order, and then, as shown in FIG. 20(*b*), the light-absorbing body 10 is formed on the photoresist 3. Subsequently, as shown in FIG. 20(*c*), a photo mask 140 constituted of photo masks 141 (first mask pattern) and 142 (second mask pattern) is arranged above the light-absorbing body 10. On this occasion, each of them are arranged so that the two photomasks 141 are set above the first through-hole 24 to be formed later, and that the photo mask 142 is interposed between the two photo masks 141.

Then, after arranging the photo mask 140, the ultraviolet light 20*b* is irradiated from above through the photo mask 140 toward the light-absorbing body 10. This gives a state in which, as for the photoresist 3 and the light-absorbing body 10, regions that are not hidden by the photo mask 140 have been exposed by the ultraviolet light 20*b*. As the result, as for the photoresist 3, the exposed region becomes the insoluble portion 3*a* and the unexposed region with the help of the photo mask 140 becomes the soluble portion 3*b*.

Subsequently, only the light-absorbing body 10 is developed. Here, since the light-absorbing body 10 is of a positive type, only the region exposed by the ultraviolet light 20*b* is removed. Accordingly, as shown in FIG. 20(*d*), a state is achieved in which only the part of the light-absorbing body 10 hidden under the lower face of the photo mask 140 is not removed and remains. Incidentally, a part of the photoresist 3 positioned under the light-absorbing body 10 becomes the soluble portion 3*b*.

Subsequently, as shown in FIG. 20(*e*), the electroconductive layer 5 is formed on the upper face of the insoluble portion 3*a* and the upper face of the light-absorbing body 10. Then, as shown in FIG. 20(*f*), the light-absorbing body 10 and the electroconductive layer 5 on the light-absorbing body 10 are subjected to liftoff, for example, in an alkaline developer to remove both of them. This leads to division of the electroconductive layer 5 to give the patterned electrodes 5*aa*, 5*ab*, 5*ac* and 5*ad*. Further, the photoresist 3 goes into such a state that the upper face of the soluble portion 3*b* is exposed.

Subsequently, as shown in FIG. 20(*g*), the photoresist 6 is formed on the upper face of the electrodes 5*aa*, 5*ab*, 5*ac* and 5*ad*, and the upper face of the exposed soluble portion 3*b*. Then, as shown in FIG. 20(*h*), a photo mask 150 is arranged above the photoresist 6, and then the ultraviolet light 20*a* is irradiated from above through the photo mask 150 toward the photoresist 6. On this occasion, the two photo masks 150 are arranged so as to hide the two soluble portions 3*b*, which have been hidden by the aforementioned two photomasks 141, completely and to hide a part of the insoluble portion 3*a*.

Incidentally, the soluble portions 3*b* having been hidden by the aforementioned photo masks 141 are kept in a state of being not hidden at this second round of exposure.

By the irradiation of the ultraviolet light 20*a*, the photoresist 6 goes into a state that regions not hidden by the two photo masks 150 have been exposed. Incidentally, since the photoresist 6 is of a negative type photoresist, the exposed region becomes the insoluble portion 6*a*, and the unexposed region with the help of the photo mask 150 becomes the soluble portion 6*b*.

In particular, since a portion that constituted the soluble portion 3*b* at the first exposure goes into an exposed state at this second round of irradiation of the ultraviolet light 20*a*, it varies from the soluble portion 3*b* to the insoluble portion 3*a*.

Lastly, the photoresists 3 and 6 are subjected to development to remove both of the insoluble portions 3*a* and 6*a* of both photoresists 3 and 6. As the result, as shown in FIG. 20(*i*), the electroforming mold (the electroforming mold shown in the embodiment 4) 1002, in which the first through-hole 24 and the second through-hole 25 are formed in a state of neighboring with each other on the substrate 1, can be manufactured.

As mentioned above, according to the method for manufacturing an electroforming mold of the embodiment, since the photoresist 3 and the light-absorbing body 10 are exposed at one time by the first irradiation of the ultraviolet light 20*b*, even an electroforming mold having a complicated figure can be easily manufactured and, at the same time, each of the electrodes 5*aa*, 5*ab*, 5*ac* and 5*ad* and the first through-hole 24 can be manufactured at a targeted position with high accuracy.

In this connection, in the embodiment, the thickness of the electroconductive layer 5 is preferably thinned as far as possible. In doing so, strength of the reflected light from the electrodes 5*aa*, 5*ab*, 5*ac* and 5*ad*, which was described in the aforementioned third embodiment, can be lowered. As the result, when an electroformed component is manufactured by using the electroforming mold 1002 of the embodiment, it is possible to prevent a "streak" from being generated on the outer surface thereof as far as possible.

In this connection, technical scope of the invention is not restricted to the aforementioned embodiments, but various changes may be made to it within a range that does not depart from the point of the invention.

All the Examples having been described hitherto can also be practiced by replacing a negative type photoresist with a positive type resist with regard to the photoresist 3 and replacing a positive type photoresist with a negative type photoresist with regard to the light-absorbing body 10. In that case, as for the photoresist 6, either a negative type photoresist or a positive type resist may be selected.

When exposing the positive type photoresist 3, the photo mask 4*a* is arranged above a region for forming the insoluble portion 3*a*, so as to allow a region for forming the soluble portion 3*b* to be irradiated by the light. And, when exposing the negative type light-absorbing body 10, the photo mask 4*b* is arranged above a region for being removed at pattern formation, so as to allow a region for forming a pattern to be irradiated by the light. In exposure of the photoresist 6, when a negative type photoresist is selected, the photo mask 4*c* is arranged above the region for forming the soluble portion 6*b*, so as to allow a region for forming the insoluble portion 3*a* to be irradiated by the light, and, when a positive type photoresist is selected, the photo mask 4*c* is arranged above a region for forming the insoluble portion 6*a*, so as to allow a region for forming the soluble portion 6*b* to be irradiated by the light.

What is claimed is:

1. An electroforming mold comprising:

an electroconductive substrate, a first negative type photosensitive material that is formed on the upper face of the electroconductive substrate and has a first through-hole in the thickness direction, an electroconductive layer formed on a part of the face of the first negative type photosensitive material opposite the face which is in contact with the electroconductive substrate, and a second negative type photosensitive material that is formed on a part of the face of the electroconductive layer opposite the face which is in contact with the first negative type photosensitive material and has a second through-hole above the face including the edge portion of the aperture face of the first through-hole with respect to the upper face of the first negative type photosensitive material.

2. The electroforming mold according to claim 1, wherein the electroconductive layer has an edge portion that is separated from the face forming the first through-hole of the first negative type photosensitive material.

3. The electroforming mold according to claim 2, wherein distance by which the electroconductive layer is separated from the face forming the first through-hole of the first negative type photosensitive material is from 1 μm to 500 μm.

4. The electroforming mold according to claim 1, wherein the electroconductive substrate has a thickness of from 100 μm to 10 mm, and the first negative type photosensitive material and the second negative type photosensitive material have a thickness of from 1 μm to 5 mm.

5. An electroforming mold comprising:

a first electroconductive layer formed on a substrate, a first negative type photosensitive material that is formed on the face of the first electroconductive layer opposite the face which is in contact with the substrate and has a first through-hole in the thickness direction, a second electroconductive layer formed on a part of the face of the first negative type photosensitive material opposite the face which is in contact with the first electroconductive layer, and a second negative type photosensitive material that is formed on a part of the face of the second electroconductive layer opposite the face which is in contact with the first negative type photosensitive material and has a second through-hole above the face including the edge portion of the aperture face of the first through-hole with respect to the upper face of the first negative type photosensitive material.

6. The electroforming mold according to claim 5, wherein the second electroconductive layer has an edge portion that is separated from the face forming the first through-hole of the first negative type photosensitive material.

7. The electroforming mold according to claim 6, wherein distance by which the second electroconductive layer is separated from the face forming the first through-hole of the first negative type photosensitive material is from 1 μm to 500 μm.

8. The electroforming mold according to claim 5, wherein the substrate has a thickness of from 100 μm to 10 mm, the first electroconductive layer has a thickness of from 5 nm to 10 μm, and the first negative type photosensitive material and the second negative type photosensitive material have a thickness of from 1 μm to 5 mm.

9. The electroforming mold according to claim 5, wherein the first and second negative type photosensitive materials have a thickness of from 1 μm to 5 mm.

10. An electroforming mold comprising:

an electroconductive substrate, a first negative type photosensitive material that is formed on the upper face of the electroconductive substrate and has a first through-hole in the thickness direction, a second negative type photosensitive material that is formed on a part of the upper face of the first negative type photosensitive material and has a second through-hole passing through in the thickness direction above the first through-hole, and an electroconductive layer formed within the second through-hole and on the upper face of the first negative type photosensitive material, the electroconductive layer not being present on the side surface of the first through-hole.

11. The electroforming mold according to claim 10, wherein the electroconductive layer is separated from the second negative type photosensitive material by a predetermined distance.

12. The electroforming mold according to claim 11, wherein the predetermined distance is set on the basis of the thickness of the second negative type photosensitive material.

13. The electroforming mold according to claim 10, wherein the electroconductive layer is separated from the aperture edge of the first through-hole by a constant distance.

14. An electroforming mold comprising:

a substrate, a first electroconductive layer formed on the upper face of the substrate, a first negative type photosensitive material that is formed on the upper face of the first electroconductive layer and has a first through-hole in the thickness direction, a second negative type photosensitive material that is formed on a part of the upper face of the first negative type photosensitive material and has a second through-hole passing through in the thickness direction above the first through-hole, and a second electroconductive layer formed within the second through-hole and on the upper face of the first negative type photosensitive material, the second elecroconductive layer not being present on the side surface of the first through-hole.

15. The electroforming mold according to claim 14, wherein the second electroconductive layer is separated from the second negative type photosensitive material by a predetermined distance.

16. The electroforming mold according to claim 15, wherein the predetermined distance is set on the basis of the thickness of the second negative type photosensitive material.

17. The electroforming mold according to claim 14, wherein the second electroconductive layer is separated from the aperture edge of the first through-hole by a constant distance.

18. An electroforming mold comprising:

an electroconductive substrate;

a first negative type photosensitive material formed on an upper face of the electroconductive substrate and having a first through-hole that exposes the electroconductive substrate;

an electroconductive layer that is formed on an upper face of the first negative type photosensitive material and surrounds the first through-hole and that is spaced from the edge of the first through-hole; and a second negative type photosensitive material formed on an upper face of the electroconductive layer and having a second through-hole that overlies and exposes both the first through-hole and a peripheral part of the electroconductive layer that surrounds the first through-hole.

19. An electroforming mold according to claim 18; wherein the peripheral part of the electroconductive layer has an edge portion that is spaced from the edge of the first through-hole a distance from 1 μm to 500 μm.

20. An electroforming mold according to claim 19, wherein the electroconductive substrate has a thickness of from 100 μm to 10 mm, and the first negative type photosensitive material and the second negative type photosensitive material have a thickness of from 1 μm to 5 mm.

21. An electroforming mold according to claim 18, wherein the electroconductive substrate has a thickness of from 100 μm to 10 mm, and the first negative type photosensitive material and the second negative type photosensitive material have a thickness of from 1 μm to 5 mm.

22. An electroforming mold according to claim 18; wherein the electroconductive layer lies in a different plane from that of the first negative type photosensitive material.

23. An electroforming mold comprising:

a substrate;

a first electroconductive layer formed on an upper face of the substrate;

a first negative type photosensitive material formed on an upper face of the first electroconductive layer and having a first through-hole that exposes the first electroconductive layer;

a second electroconductive layer that is formed on an upper face of the first negative type photosensitive material and surrounds the first through-hole and that is spaced from the edge of the first through-hole; and a second negative type photosensitive material formed on an upper face of the second electroconductive layer and having a second through-hole that overlies and exposes both the first through-hole and a peripheral part of the second electroconductive layer that surrounds the first through-hole.

24. An electroforming mold according to claim 23; wherein the peripheral part of the second electroconductive layer has an edge portion that is spaced from the edge of the first through-hole a distance from 1 μm to 500 μm.

25. An electroforming mold according to claim 24, wherein the electroconductive substrate has a thickness of from 100 μm to 10 mm, and the first negative type photosensitive material and the second negative type photosensitive material have a thickness of from 1 μm to 5 mm.

26. An electroforming mold according to claim 23, wherein the electroconductive substrate has a thickness of from 100 μm to 10 mm, and the first negative type photosensitive material and the second negative type photosensitive material have a thickness of from 1 μm to 5 mm.

27. An electroforming mold according to claim 23; wherein the second electroconductive layer lies in a different plane from that of the first negative type photosensitive material.

28. An electroforming mold comprising:

an electroconductive substrate;

a first negative type photosensitive material formed on an upper face of the electroconductive substrate and having a first through-hole one end of which exposes the electroconductive substrate and the side of which exposes the first negative type photosensitive material;

a second negative type photosensitive material formed on an upper face of the first negative type photosensitive material and having a second through-hole that overlies both the first through-hole and a peripheral part of the upper face of the first negative type photosensitive material that surrounds the first through-hole; and an electroconductive layer disposed within the second through-hole on the peripheral part of the upper face of the first negative type photosensitive material and surrounding the first through-hole, the electroconductive layer not being present on the side of the first through-hole.

29. An electroforming mold according to claim 28, wherein the electroconductive layer is spaced from and does not contact the second negative type photosensitive material.

30. An electroforming mold according to claim 29; wherein the distance at which the electroconductive layer is spaced from the second negative type photosensitive material is a function of the thickness of the second negative type photosensitive material.

31. An electroforming mold according to claim 29; wherein the electroconductive layer is spaced from the edge of the first through-hole.

32. An electroforming mold according to claim 31; wherein the electroconductive layer is spaced a constant distance from the edge of the first through-hole.

33. An electroforming mold comprising:

a substrate;

a first electroconductive layer formed on an upper face of the substrate;

a first negative type photosensitive material formed on an upper face of the first conductive layer and having a first through-hole one end of which exposes the first conductive layer and the side of which exposes the first negative type photosensitive material;

a second negative type photosensitive material formed on an upper face of the first negative type photosensitive material and having a second through-hole that overlies both the first through-hole and a peripheral part of the upper face of the first negative type photosensitive material that surrounds the first through-hole; and a second electroconductive layer disposed within the second through-hole on the peripheral part of the upper face of the first negative type photosensitive material and surrounding the first through-hole, the second electroconductive layer not being present on the side of the first through-hole.

34. An electroforming mold according to claim 33, wherein the second electroconductive layer is spaced from and does not contact the second negative type photosensitive material.

35. An electroforming mold according to claim 34; wherein the distance at which the second electroconductive layer is spaced from the second negative type photosensitive material is a function of the thickness of the second negative type photosensitive material.

36. An electroforming mold according to claim 34; wherein the second electroconductive layer is spaced from the edge of the first through-hole.

37. An electroforming mold according to claim 36; wherein the second electroconductive layer is spaced a constant distance from the edge of the first through-hole.

* * * * *